US008904720B2

(12) United States Patent
Woodward et al.

(10) Patent No.: US 8,904,720 B2
(45) Date of Patent: Dec. 9, 2014

(54) MULLION COVER LINKAGE

(75) Inventors: Bradley D. Woodward, Warroad, MN (US); Chris Ratzlaff, Salol, MN (US)

(73) Assignee: Marvin Lumber and Cedar Company, Warroad, MN (US)

( * ) Notice: Subject to any disclaimer, the term of this patent is extended or adjusted under 35 U.S.C. 154(b) by 90 days.

(21) Appl. No.: 13/427,185

(22) Filed: Mar. 22, 2012

(65) Prior Publication Data

US 2012/0240492 A1 Sep. 27, 2012

Related U.S. Application Data

(60) Provisional application No. 61/467,689, filed on Mar. 25, 2011.

(51) Int. Cl.
*E06B 3/32* (2006.01)
*E06B 1/36* (2006.01)

(52) U.S. Cl.
CPC ..... *E06B 1/363* (2013.01)
USPC ..... 52/204.66; 52/71; 52/204.1; 49/380

(58) Field of Classification Search
CPC ..... E04B 2/96; E06B 1/6007; E06B 3/44; E06B 1/04; E06B 1/34; E06B 1/342; E06B 1/366; E06B 1/542; E06B 3/5871
USPC ..... 52/71, 204.1, 204.5, 204.62, 204.66, 52/204.68, 235, 656.5, 656.6, 717.01, 52/FOR. 128, 281, 282.1, 282.3, 282.4, 52/309.16; 49/380
See application file for complete search history.

(56) References Cited

U.S. PATENT DOCUMENTS

| | | | | |
|---|---|---|---|---|
| 4,606,162 | A * | 8/1986 | Wendt | 52/282.4 |
| 4,663,896 | A * | 5/1987 | Dunnick | 52/71 |
| 4,934,115 | A * | 6/1990 | Nozaki | 52/71 |
| 5,133,108 | A * | 7/1992 | Esnault | 16/225 |
| 6,360,498 | B1 * | 3/2002 | Westphal | 52/204.5 |
| 6,662,512 | B2 * | 12/2003 | Westphal | 52/204.5 |
| 6,722,089 | B2 * | 4/2004 | Budzinski | 52/204.5 |
| 2001/0015027 | A1 * | 8/2001 | Nurcombe | 40/700 |
| 2013/0212973 | A1 * | 8/2013 | Saunders et al. | 52/656.5 |

* cited by examiner

*Primary Examiner* — William Gilbert
(74) *Attorney, Agent, or Firm* — Schwegman Lundberg & Woessner, P.A.

(57) ABSTRACT

A mullion cover linkage assembly includes a first wing including a first wing span extending from a first wing frame end to a first wing pivot end. The first wing frame end is configured for coupling with a first window frame. The linkage further includes a second wing having a second wing span extending from a second wing frame end to a second wing pivot end. The first and second wings are movably coupled with one another as a linkage. Optionally, a pivot clip is rotatably coupled between the first and second pivot flanges at first and second pivot joints each including respective pivot flanges of the first and second wings received in one of the first and second clip sockets.

25 Claims, 16 Drawing Sheets

MULLION COVER LINKAGE

CLAIM OF PRIORITY

This patent application claims the benefit of priority, under 35 U.S.C. §119(e), to U.S. Provisional Patent Application Ser. No. 61/467,689, entitled "MULLION COVER LINKAGE," filed on Mar. 25, 2011, which is hereby incorporated by reference herein in its entirety.

TECHNICAL FIELD

Window and door assemblies including mullion gaps.

BACKGROUND

Two or more windows or doors are sometimes installed side by side with a mullion gap positioned therebetween. The mullion gap is filled with a vertical strip between windows or doors to form a mullion joint. Mullion joints are generally capped with weather resistant caps to protect the components of the windows or doors lying along the mullion joints.

Caps used in mullion joints include rigid components, such as molded plastic or extruded aluminum pieces that span the mullion joints and are fastened with the frames of the respective windows or doors. Where the windows or doors are oriented at an angle to each other specified caps are needed that extend across the mullion joints according to the angle of the windows or doors, for instance at molded angles. Where the windows or doors are not oriented (or cannot be oriented) at an angle compatible with a generic cap customized tooling is needed to generate the unique cap for the mullion joint. Using customized tooling is expensive as steel dies or molds are machined for a small number of unique parts. Additionally, the customized tooling is time intensive to manufacture and delays the installation of windows and doors that are otherwise ready for immediate installation.

Further, caps sized for a particular spacing or angle between windows or doors are not, in some examples, adequately sized or shaped for use with mullion joints having different spacing or angles. Additional caps must therefore be kept on hand or manufactured with existing tools (configured for the other spacing or angle) as needed to provide adequate cap configurations to meet even standard ranges of spacing and angles between windows and doors.

BRIEF DESCRIPTION OF THE DRAWINGS

A more complete understanding of the present subject matter may be derived by referring to the detailed description and claims when considered in connection with the following illustrative Figures. In the following Figures, like reference numbers refer to similar elements and steps throughout the Figures.

Elements and steps in the Figures are illustrated for simplicity and clarity and have not necessarily been rendered according to any particular sequence. For example, steps that may be performed concurrently or in different order are illustrated in the Figures to help to improve understanding of examples of the present subject matter.

DESCRIPTION OF THE DRAWINGS

In the following detailed description, reference is made to the accompanying drawings which form a part hereof, and in which is shown by way of illustration specific examples in which the subject matter may be practiced. These examples are described in sufficient detail to enable those skilled in the art to practice the subject matter, and it is to be understood that other examples may be utilized and that structural changes may be made without departing from the scope of the present subject matter. Therefore, the following detailed description is not to be taken in a limiting sense, and the scope of the present subject matter is defined by the appended claims and their equivalents.

The present subject matter may be described in terms of functional block components and various processing steps. Such functional blocks may be realized by any number of techniques, technologies, and methods configured to perform the specified functions and achieve the various results. For example, the present subject matter may be practiced in conjunction with any number of devices, and the systems described are merely exemplary applications.

Figure 1:
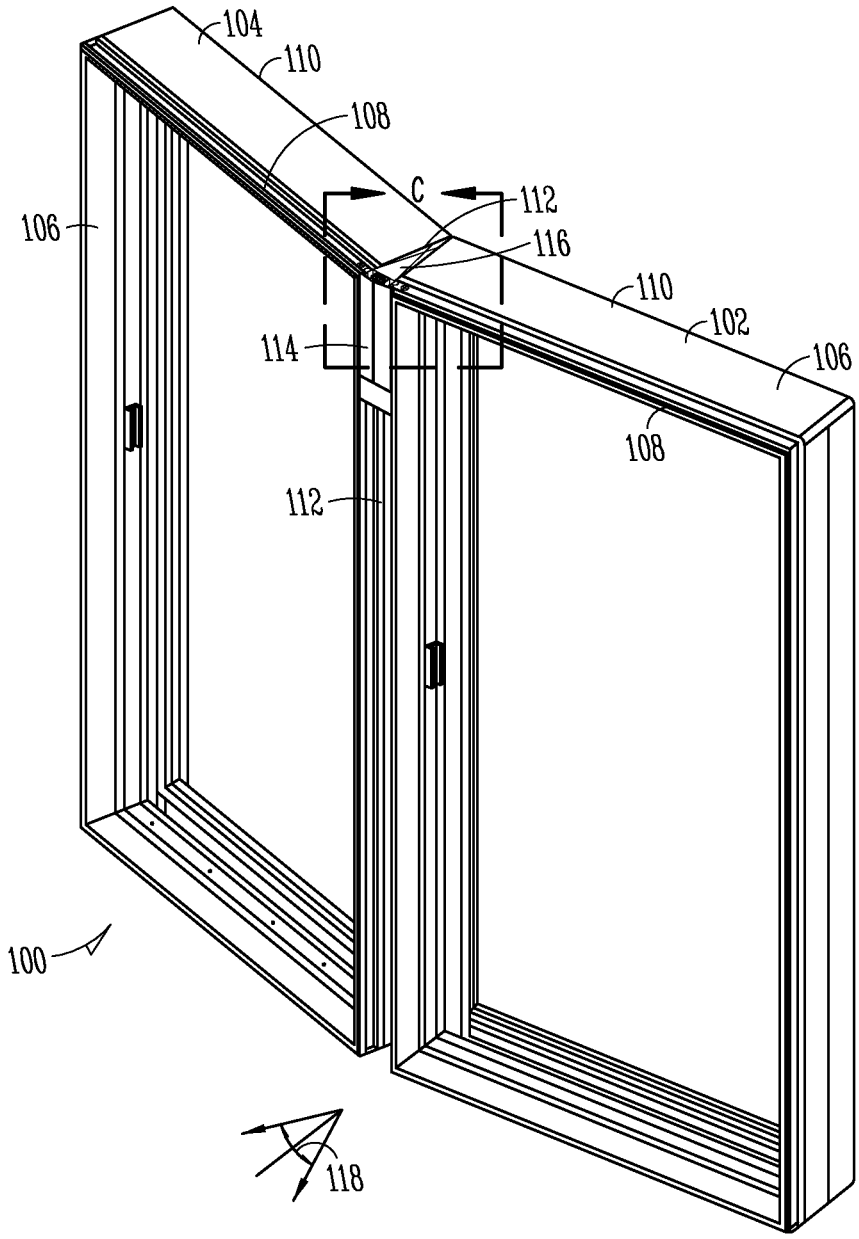
FIG. 1 is a perspective view of one example of a window assembly including a mullion cover linkage.

FIG. 1 shows one example of a fenestration assembly 100. As shown in FIG. 1, the fenestration assembly 100 includes first and second windows 102, 104. In another example, the fenestration assembly 100 includes a plurality of doors including first and second doors in place of the first and second windows 102, 104. Each of the first and second windows 102, 104 includes a window frame 106 including frame exterior portions 108 and frame interior portions 110. As shown in FIG. 1, the first and second windows 102, 104 are oriented at an angle relative to each other, for instance, at the orientation angle 118. A mullion gap 112 is formed between the window frames 106 and the first and second windows 102, 104. In one example, the first and second windows 102, 104 form a portion of a bay window.

Referring again to FIG. 1, a mullion cover linkage 114 is coupled across the mullion gap 112. As will be described in further detail below, the mullion cover linkage 114 provides an adjustable assembly that extends across the mullion gap 112, conceals the mullion gap 112 and provides a configurable linkage capable of adjustment for use with a variety of mullion gaps 112 having a plurality of orientation angles 118 (as well as different spacing between the window frames 106 at the interior portions 110). As shown in FIG. 1, the mullion cover linkage 114 is sectioned adjacent to portions of the first and second windows 102, 104 to expose the mullion gap 112. In practice the mullion cover linkage 114 extends the length (or a portion of the length) of the window frames 106 and thereby provides full coverage and concealment of the mullion gap 112. Referring again to FIG. 1, a locking block 116 is positioned between the window frames 106. As will be described in further detail below, the locking block 116 is sized and shaped for engagement with the window frames 106 as well as a portion of the mullion cover linkage 114. The locking block 116 engages with the mullion cover linkage 114 and constrains the mullion cover linkage 114 from moving from the configured orientation such as the orientation shown in FIG. 1. The mullion cover linkage 114 described herein provides a fully adjustable cover that is capable of pivoting in order to span the mullion gap 112, and in some examples match the orientation angle 118. The mullion cover linkage 114 thereby precludes the need for customized tools needed to generate unique static covers that would otherwise extend across a mullion gap having a particular orientation angle and gap spacing. Further, the mullion cover linkage 114 provides a decorative planar appearance with a single continuous shadow line as described herein. The decorative planar exterior appearance of the mullion cover linkage 114 seals the mullion gap 112 between the first and second windows 102, 104 along the full length of the window frames 106 thereby providing protection for the inner components of the windows 102, 104.

Figure 2A:
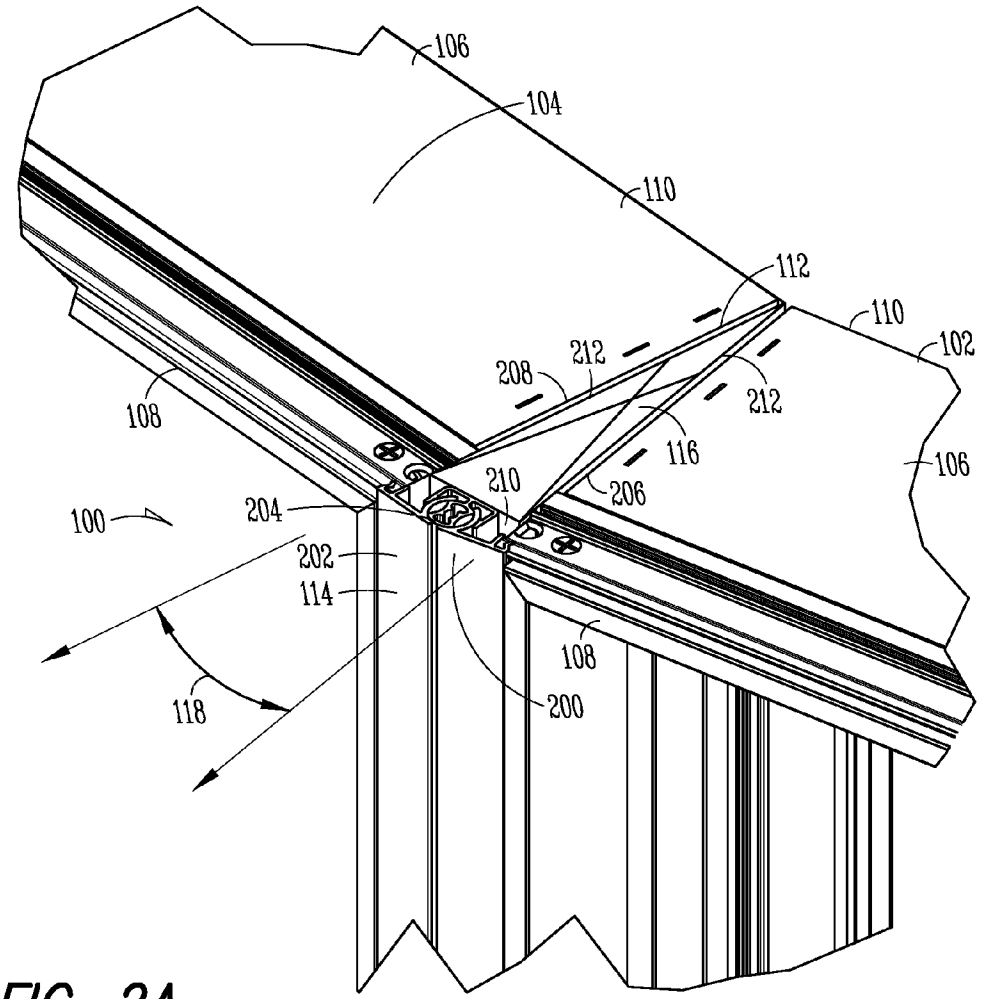
FIG. 2A is a detailed perspective view of the window assembly of FIG. 1.

FIG. 2A shows a detailed perspective view of the fenestration assembly 100 previously shown in FIG. 1. As shown, the mullion cover linkage 114 is again coupled between the frame exterior portions 108 of the window frames 106 of the first and second windows 102, 104. As shown in FIG. 2A, the mullion cover linkage 114 includes first and second wings 200, 202 spanning the mullion gap 112. A pivot clip 204 is coupled between the first and second wings 200, 202 and provides a feature for rotatably coupling the first and second wings 200, 202. The first and second wings 200, 202 are thereby able to pivot around the common axis created with the wings and the pivot clip 204 to provide the adjustable angled exterior surface shown in FIG. 2A. The first and second wings 200, 202 are oriented in one example at an angle corresponding to the orientation angle 118 provided according to the spacing of the first and second windows 102, 104 (see FIGS. 1, 2A). For instance, the first and second wings are each at approximately half of the angle relative to the orientation angle 118 where the wing angles are measures from a horizontal line perpendicular to a line bisecting the orientation angle 118 (such a horizontal line is described in further detail below).

Referring again to FIG. 2A, the locking block 116 is shown positioned within the mullion gap 112. The locking block includes an anchoring face 210 sized and shaped for engagement with a portion of the mullion cover linkage 114. As shown in FIG. 2A, the anchoring face 210 is engaged with the pivot clip 204. The locking block 116 further includes block faces 212 sized and shaped for engagement with first and second frames surfaces 206, 208 of the first and second windows 102, 104, respectively. The engagement of the locking block 116 with each of the first and second frame surfaces 206, 208 and the pivot clip 204, for instance, the anchoring face 210, immobilizes the mullion cover linkage 114 in the orientation shown. That is to say, after adjustment of the mullion cover linkage 114 to a configuration as desired, for instance a configuration that corresponds to the orientation angle 118 shown in FIG. 2A as well as the spacing (laterally) of the first and second windows 102, 104 to each other, the locking block 116 engages with the pivot clip 204 and immobilizes the mullion cover linkage 114 against further movement of the first and second wings 200, 202 (such as rotation). Additionally, and as described in further detail below, the engagement of the locking block 116 with the mullion cover linkage 114 at the pivot clip 204 limits the movement of the linkage 114. For instance, the first and second wings 200, 202 rotate relative to the pivot clip 204. Immobilizing the first and second wings substantially prevents the disengagement of the first and second wings 200, 202 from the pivot clip 204 through rotation out of the sockets within the pivot clip 204. The first and second wings 200, 202 are thereby reliably coupled with the pivot clip 204, and the mullion cover linkage is retained in the assembled configuration shown after installation with the windows 102, 104. The mullion gap 112 is thereby reliably covered and concealed by the mullion cover linkage 114 after installation of the mullion cover linkage 104 with the first and second windows 102, 104.

Figure 2B:
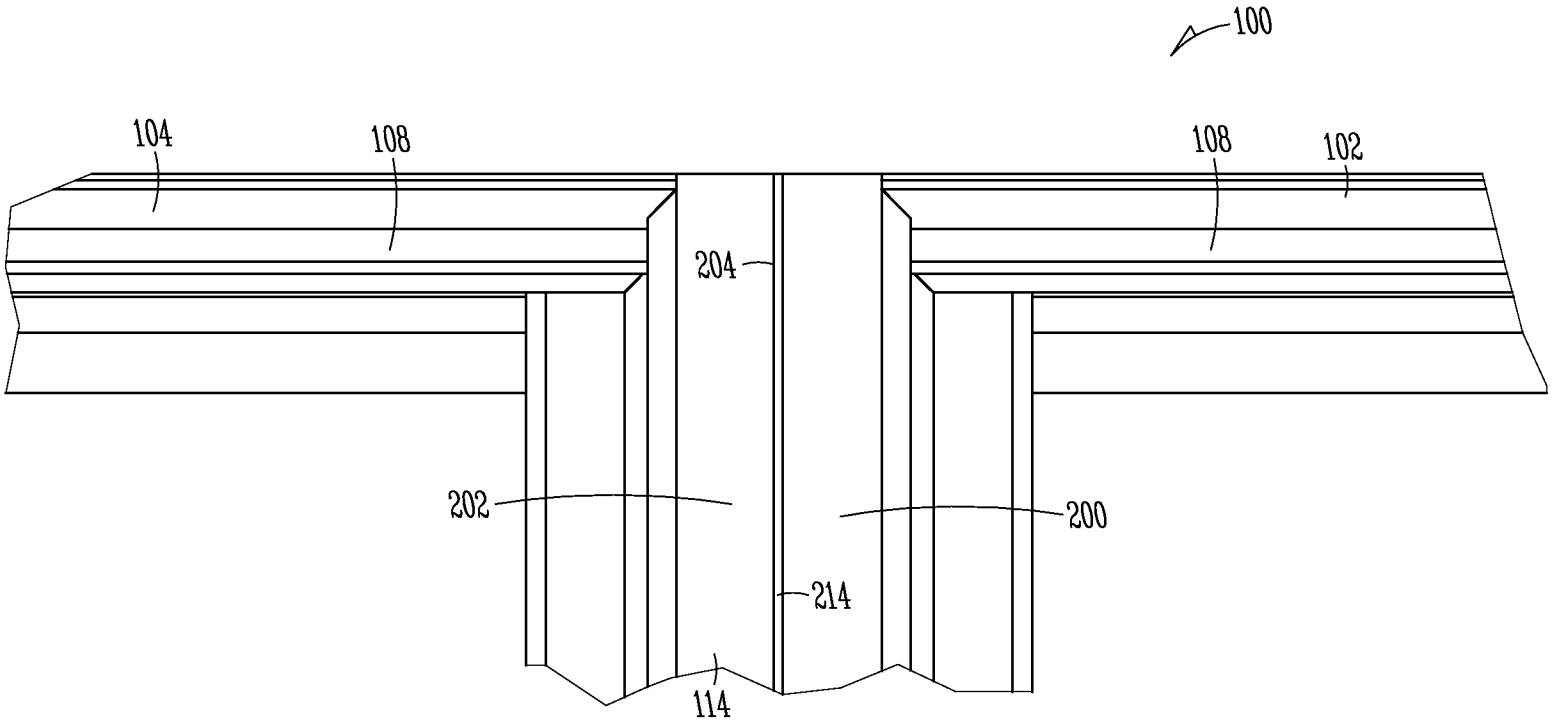
FIG. 2B is a detailed front view of the window assembly of FIG. 1.

Referring now to FIG. 2B, a detailed front view of the fenestration assembly 100 is provided. As shown the first and second windows 102, 104 are positioned adjacent to each other with the mullion cover linkage 114 installed across the mullion gap 112 (the mullion gap 112 is shown in FIGS. 1 and 2A). As previously described, the mullion cover linkage 114 includes the first and second wings 200, 202 spanning the mullion gap 112. The pivot clip 204 is shown within a shadow line 214 extending along the mullion cover linkage 114. The pivot clip 204 is thereby substantially concealed within the shadow line 214 and the first and second wings 200, 202 thereby provide an overall continuous planar appearance to the mullion cover linkage 114 while still being configured to adjustably span the mullion gap 112 at an angle according to the orientation angle 118 shown in FIGS. 1 and 2A. Stated another way, the pivot of the mullion cover linkage 114 occurs at the pivot clip 204 behind the first and second wings 200, 202. The first and second wings 200, 202 thereby provide a substantially planar appearance that is aesthetically pleasing with a single shadow line 214 extending along the mullion cover linkage 114.

Figure 3A:
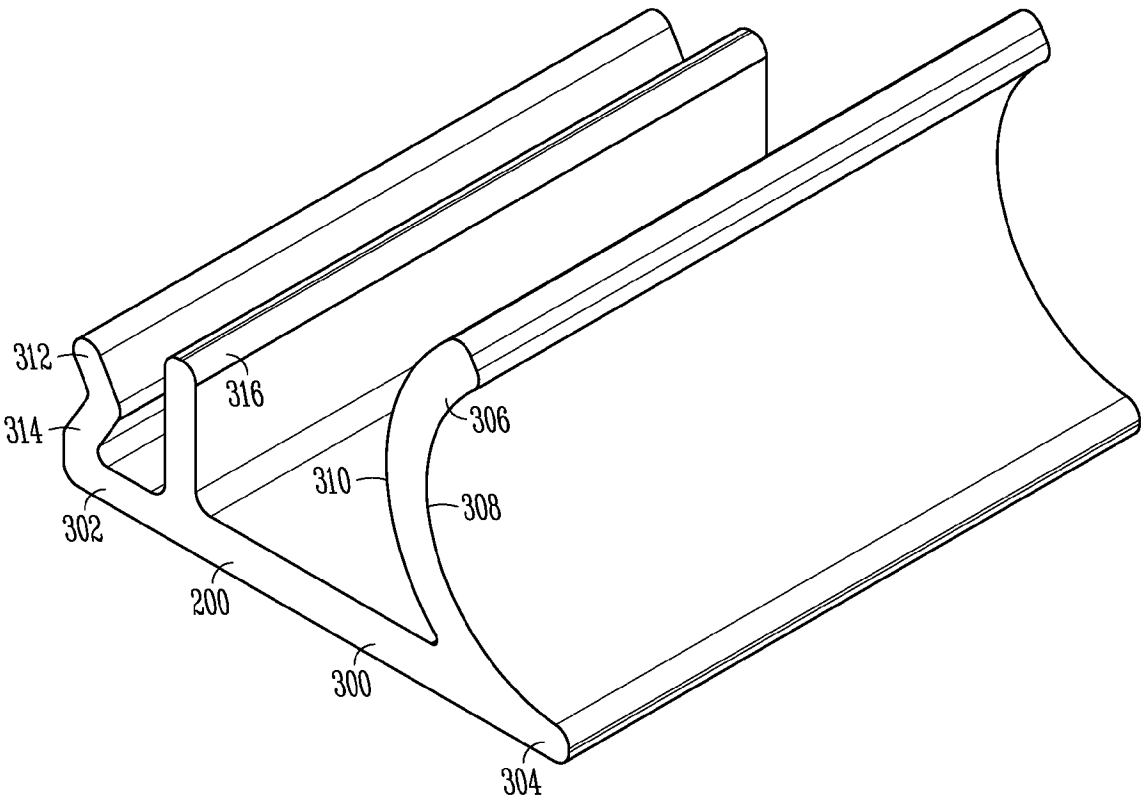
FIG. 3A is a perspective view of one example of a wing included in the mullion cover linkage shown in FIG. 1.
Figure 3B:
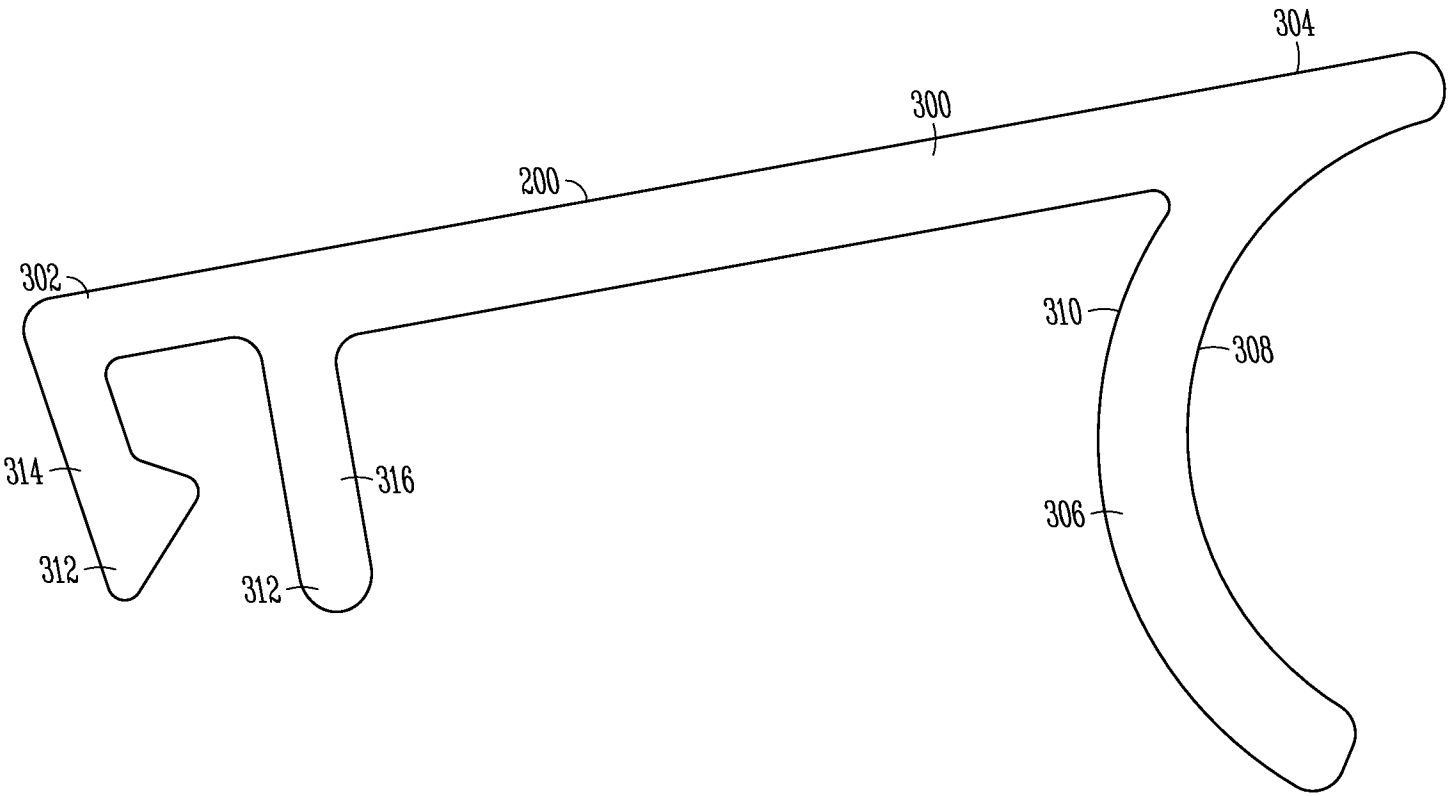
FIG. 3B is a cross sectional view of the wing shown in FIG. 3A.

FIGS. 3A and 3B show one example of a wing such as the first wing 200 shown in FIGS. 2A and 2B. As previously described, the first and second wings 200, 202 are coupled with the pivot clip 204 to form the mullion cover linkage 114. The first and second wings 200, 202 extend across the mullion gap 112 and provide a continuous cover between the first and second windows 102, 104 as shown in FIG. 1. In one example, the second wing 202 is a mirror image of the first wing 200. By using mirror imaged wings, each of the first and second wings 200, 202 are produced from a single die (for instance by extrusion) thereby minimizing the tooling needed for manufacturing the mullion cover linkage 114.

The first wing 200 (in a similar manner to the second wing 202) includes a wingspan 300 extending between a frame end 302 and a pivot end 304. The frame end 302 is sized and shaped for coupling with one of the window frames 106 of the first and second windows 102, 104 shown in FIG. 1. The pivot end 304 is sized and shaped for coupling with the pivot clip 204 with a pivot flange 306 extending from the pivot end 304.

The pivot flange 306 includes first and second flange faces 308, 310. As will be described in further detail below the first and second flange faces 308, 310 facilitate slidable coupling of the pivot flange 306 with the pivot clip 204 to form the mullion cover linkage 114. Additionally, the pivot flange 306 with the first and second flange faces 308, 310 provides a rotatable or hinged coupling between the pivot clip 204 and the first and second wings 200, 202. Stated another way, in one example, the pivot flange 306 cooperates with the corresponding portions of the pivot clip 204 (described below) to provide the hinged features of the mullion coverage linkage 114 to facilitate deflection of the mullion cover linkage across the mullion gap 112 (and other mullion gaps with different spacing and orientation angles) shown in FIG. 1. As will be described in further detail below, the first and second flange faces 308, 310 engage in a three point engagement with the pivot clip 204 to facilitate the sliding movement or slidable clamping of the first and second wings 200, 202 with the pivot clip 204. The first and second wings 200, 202 are thereby able to rotate relative to the pivot clip 204 while the pivot clip is configured to maintain a snug engagement along the pivot flange 306 and retain the first and second wings 200, 202 at whatever orientation the wings are rotated relative to the pivot clip 204. The first and second wings 200, 202 further include a frame fastener 312 positioned adjacent to the frame end 302. One example of the frame fastener 312 is shown in FIGS. 3A and 3B. In the example, the frame fastener 312 includes a hook 314 and a ridge 316. The hook and ridge 314, 316 cooperate to engage the frame end 302 with the corresponding portion of the window frame 106. As shown in FIG. 2A, the first and second wings 200, 202 are coupled with the frame exterior portions 108. In another example, the frame fastener 312 including the hook and ridge 314, 316 are sized and shaped for coupling with another portion of the first and second windows 102, 104 such as the frame interior portions 110 (for instance where the linkage 114 is installed on along the interior portions of the windows 102, 104).

The wingspan 300 of the first and second wings 200, 202 has a width extending between the frame end and the pivot end 302, 304. The width of the wingspan 300 is chosen according to a range of spacing between the first and second windows 102, 104. For instance, where the first and second windows 102, 104 are at an orientation angle 118 of around 1 to 15 degrees the wingspan 300 in the first and second wings 200, 202 is a first width. In another example, where the first and second windows 102, 104 (shown in FIG. 1) are at another orientation angle 118, for instance around 45 degrees, the wingspan 300 of the first and second wings 200, 202 is larger to facilitate greater deflection of the first and second wings relative to the pivot clip while still allowing coupling with the frames 106 (subject to the depth of the windows 102, 104). Further description of the first and second wings 200, 202 having varying widths is provided below. With each of the first and second wings 200, 202 having one or more wingspans 300 (e.g., widths) the wingspans 300 provide a continuous, aesthetically pleasing surface between the frame end 302 and the pivot end 304 of each of the wings 200, 202. Referring again to FIG. 2B, the first and second wings 200, 202 thereby provide a continuous mullion cover linkage 114 extending across the mullion gap 112 broken only by a shadow line 214 extending between the first and second wings 200, 202.

Figure 4A:
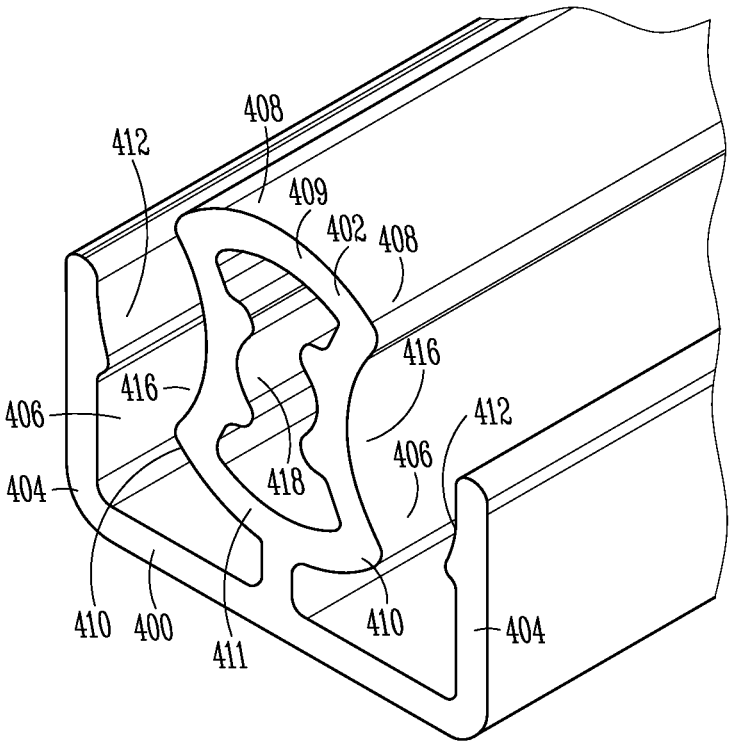
FIG. 4A is a perspective view of one example of a pivot clip included in the mullion cover linkage shown in FIG. 1.
Figure 4B:
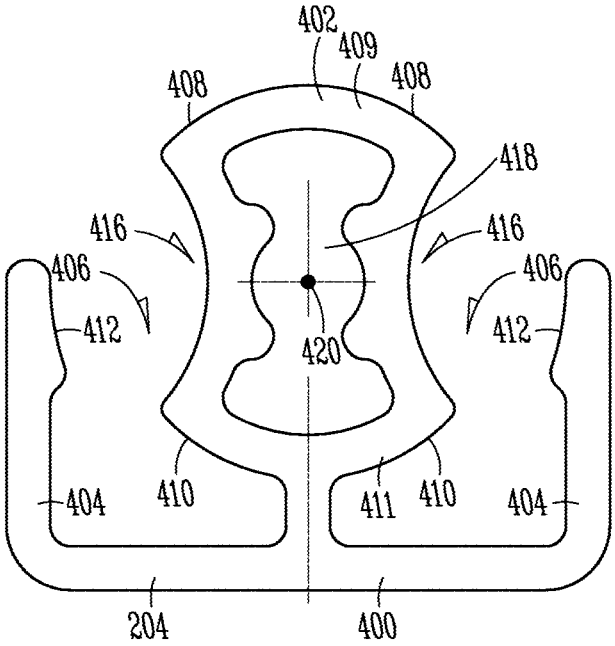
FIG. 4B is a cross sectional view of the pivot clip shown in FIG. 4A.

FIGS. 4A and 4B show one example of a pivot clip 204. As previously described, the pivot clip 204 is sized and shaped for engagement with the first and second wings 200, 202 to form the mullion cover linkage 114 shown in FIGS. 1, 2A and 2B. Referring again to FIGS. 4A and 4B, the pivot clip 204 as shown includes a clip base 400 and a pivot bar 402 coupled with the clip base 400. In one example, the clip base 400 has a U-shape including clip arms 404 extending around at least a portion of the pivot bar 402. As will be described in further detail below, the clip arms 404 are sized and shaped for slidable clamping with the pivot flanges 306 of the first and second wings 200, 202 to facilitate rotatable movement of the first and second wings 200, 202 relative to the pivot clip 204. In the example shown in FIG. 4B, clip sockets 406 are provided around the pivot clip 204. For example, clip sockets 406 extend around the pivot bar 402. The clip sockets 406 are each sized and shaped to receive one of the pivot flanges 306 in the first and second wings 200, 202 as shown in FIGS. 3A and 3B. For instance, the pivot clip 204 includes a first pivot surface along the pivot bar 402 and an opposed pivot surface along the clip arms 404. The opposed pivot surfaces slidably engage along the first and second flange faces 308, 310 of the pivot flange 306. The pivot flange 306 is slidably clamped therebetween and the slidable coupling facilitates rotation of the first and second wings 200, 202 relative to the pivot clip 204.

In the example shown in FIGS. 4A and 4B, first, second and third pivot surfaces 408, 410, 412 are provided with the pivot clip 204. The first and second pivot surfaces 408, 410 are provided at two portions of the pivot bar 402. The first pivot surface 408 is provided at a distal portion 409 of the pivot bar 402. The second pivot surface 410 is provided at a proximal portion 411 of the pivot bar 402. Interposed between the first and second pivot surfaces 408, 410 is the third pivot surface 412 positioned in the example shown on the clip arms 404. As shown, the third pivot surface 412 is directed toward the first and second pivot surfaces 408, 410 by way of the clip arms 404 extending around a portion of the pivot bar 402. As will be described in further detail below, the first, second, third pivot surfaces 408, 410, 412 are positioned in the orientation shown to provide a three point clamping engagement with the pivot flanges 306 of the first and second wings 200, 202. The pivot surfaces 408, 410, 412 are thereby able to snugly hold and slidably engage with the pivot flanges 306 to ensure the first and second wings 200, 202 are rotatable relative to the pivot clip 204 (and each other) while at the same time the clamping engagement between the pivot surfaces and the pivot flanges 306 snugly holds the first and second wings 200, 202 in place relative to the pivot clip when deflection forces are not applied to the first and second wings 200, 202 or the pivot clip 204. Optionally, the engagement between the pivot flanges 306 and one or more of the opposed pivot surfaces 408, 410, 412 provides a seal between the wings 200, 202 and the pivot clip 204 to provide a sealed mullion cover linkage 114 for installation.

In the example shown in FIG. 4B, the first and second wings 200, 202 (FIGS. 2A, B) are sized and shaped to rotate around a common axis, such as the pivot axis 420, formed within a screw boss 418 of the pivot bar 402. The first and second wings 200, 202, when coupled with the pivot clip 204, rotate around the pivot axis (e.g., a common axis). In another example, where the pivot bar 402 has a width greater than the width shown in FIG. 4B, the first and second pivot surfaces 408, 410 are positioned further away from one another and in such an example the first and second wings 200, 202 are configured for rotation around separate axes extending through the pivot bar 402.

Referring again to FIG. 4B, in one example, the pivot clip 204 includes sealant grooves 416 extending along at least a portion of the pivot clip 204. In the example shown, the sealant grooves 416 extend along the length of the pivot bar 402, for instance, extending along the entire length of the pivot clip 204. Optionally, a sealant such as silicone caulk is applied along the sealant grooves 416 prior to coupling with the first and second wings 200, 202. The sealant within the sealant grooves 416 provides a reliable seal between the first and second wings 200, 202 and the pivot clip 204. The seal provided with the sealant grooves 416 having a sealant therein substantially prevents the ingress of moisture beyond the mullion cover linkage 114. Additionally, the sealant within the sealant grooves 416 cooperates with engagement of the clip base 400, for instance, with the anchoring face 210 of the walking block 116 as shown in FIG. 2A. The sealant within the sealant grooves 216 and the engagement at the anchoring face 210 with the clip base 400 thereby substantially immobilizes the mullion cover linkage 104 in a desired orientation such as an orientation corresponding to the orientation angle 118 of the first and second windows 102, 104 as shown in FIG. 1.

Figure 5:
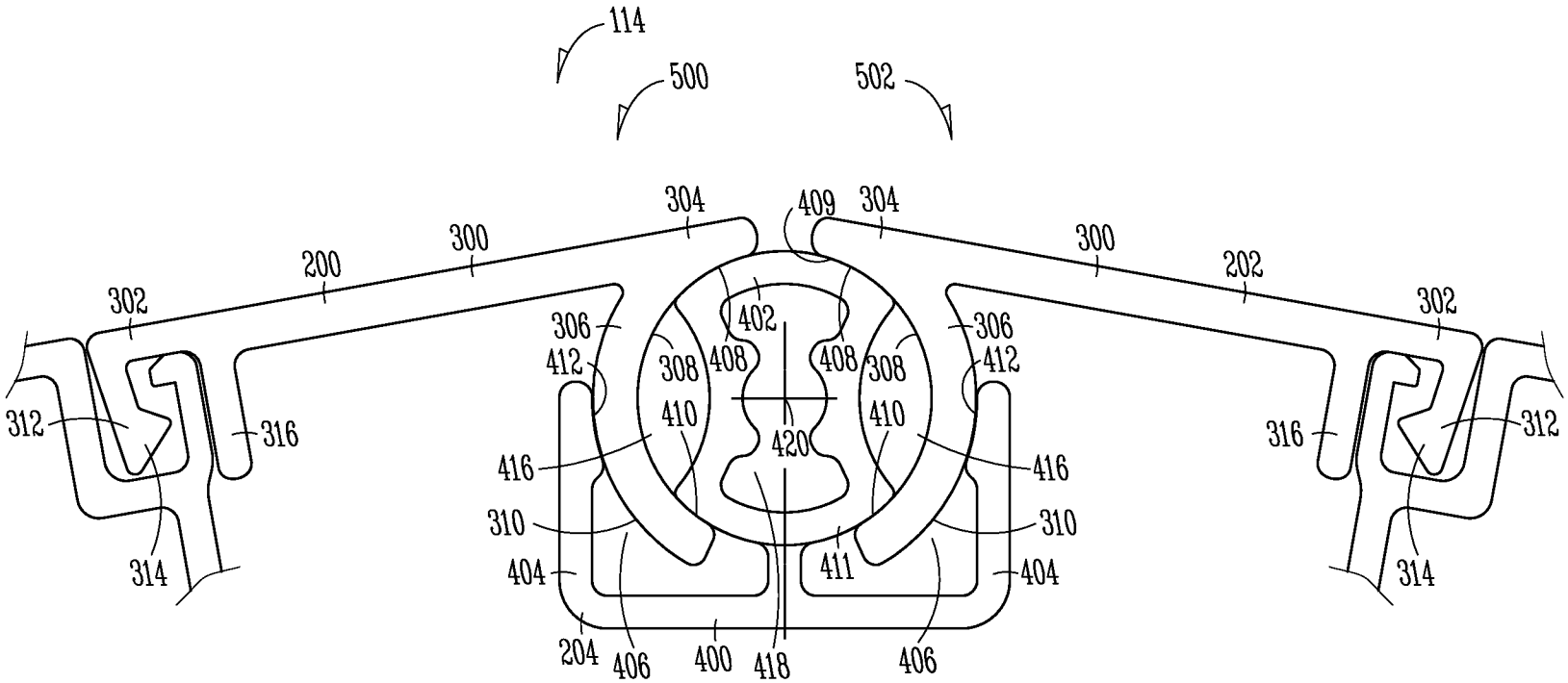
FIG. 5 is a cross sectional view of the mullion cover linkage shown in FIG. 1.

FIG. 5 shows a cross-sectional view of the mullion cover linkage 114. As previously described, the mullion cover linkage 114 includes first and second wings 200, 202 movably coupled with the pivot clip 204. The first and second wings 200, 202 are coupled with the pivot clip 204 adjacent to pivot ends 304 of each of the wings 200, 202. The pivot ends 304, in one example, include pivot flanges 306. The pivot flanges 306 are slidably clamped within the pivot clip 204. As shown in FIG. 5, opposed pivot surfaces of the pivot clip 204 are slidably coupled along the first and second flange faces 308, 310 of each of the pivot flanges 306 to facilitate rotational movement of the first and second wings 200, 202 relative to the pivot clip 204. In the examples shown in FIG. 5 the pivot bar 402 includes first and second pivot surfaces 408, 410 positioned at distal and proximal portions 409, 411 of the pivot bar 402. The pivot clip 204 further includes a third pivot surface 412 in the example shown opposed to the first and second pivot surfaces 408, 410. The third pivot surface 412 is interposed between the first and second pivot surfaces 408, 410.

When the pivot flanges 306 are coupled with pivot clip 204 by rotation of the pivot flange 306 into interposing engagement between the first, second and third pivot surfaces 408, 410, 412 the pivot flanges 306 are engaged in three point contact with the pivot clip and each of the pivot flanges 306 is snugly engaged between a clip arm 404 and the pivot bar 402. Further, the snug engagement between the pivot bar 402 and the clip arms 404 with each of the first and second wings 200, 202 provides a tight and reliable coupling between the first and second wings and the pivot clip 204. Unintended decoupling of the first and second wings 200, 202 after coupling with the pivot clip 204 is thereby substantially avoided. Further, when installed with the first and second windows 102, 104 (shown in FIG. 1) the mullion cover linkage 114 including the first and second wings 200, 202 provides a reliable cover that is not prone to undesirable disassembly or decoupling because of wind loads, shifting of the first and second window 102, 104 relative to each other, tampering and the like.

Further, in another example, the pivot bar 402 includes the sealant grooves 416. In one example, the sealant grooves 416 are filled with a sealant that provides a seal between the first and second wings 200, 202 and the pivot clip 204 to substantially prevent the ingress of moisture through the mullion cover linkage 114. Additionally, the sealant between the first and second wings 200, 202 and the pivot clip 204 acts as an adhesive between the first and second wings 200, 202 and substantially prevents decoupling from the pivot clip 204. In still another example, with the optional locking block 116 engaged with the clip base 400 of the pivot clip 204 the pivot clip 204 is further prevented from moving relative to the first and second wings 200, 202. For instance, pushing of the first and second wings 200, 202 from the distal portion 409 toward the proximal portion 411 is substantially prevented by the locking block 116. Deflection of the clip arms 404 and subsequent snapping of the pivot flanges 306 out of the clip sockets 406 is thereby substantially prevented.

As shown in FIG. 5, the first wing 200 and the pivot clip 204 form a first pivot joint 500 therebetween. For instance, the pivot flange 306 is engaged with the opposed pivot surfaces 408, 410, 412 of the pivot bar 402 to form the rotatable first pivot joint 500 therebetween. In a similar manner a second pivot joint 502 is formed between the second wing 202 and the pivot clip 204 through engagement between the pivot flange 306 of the second wing and the respective pivot surfaces 408, 410, 412. As shown in FIG. 5, the first and second pivot joints 500, 502 have a common rotational axis along the pivot axis 420. In another example, where the pivot bar 402 has a greater width than that shown the rotational axes of the first and second wings 200, 202 are spaced apart from one another.

Figure 6:
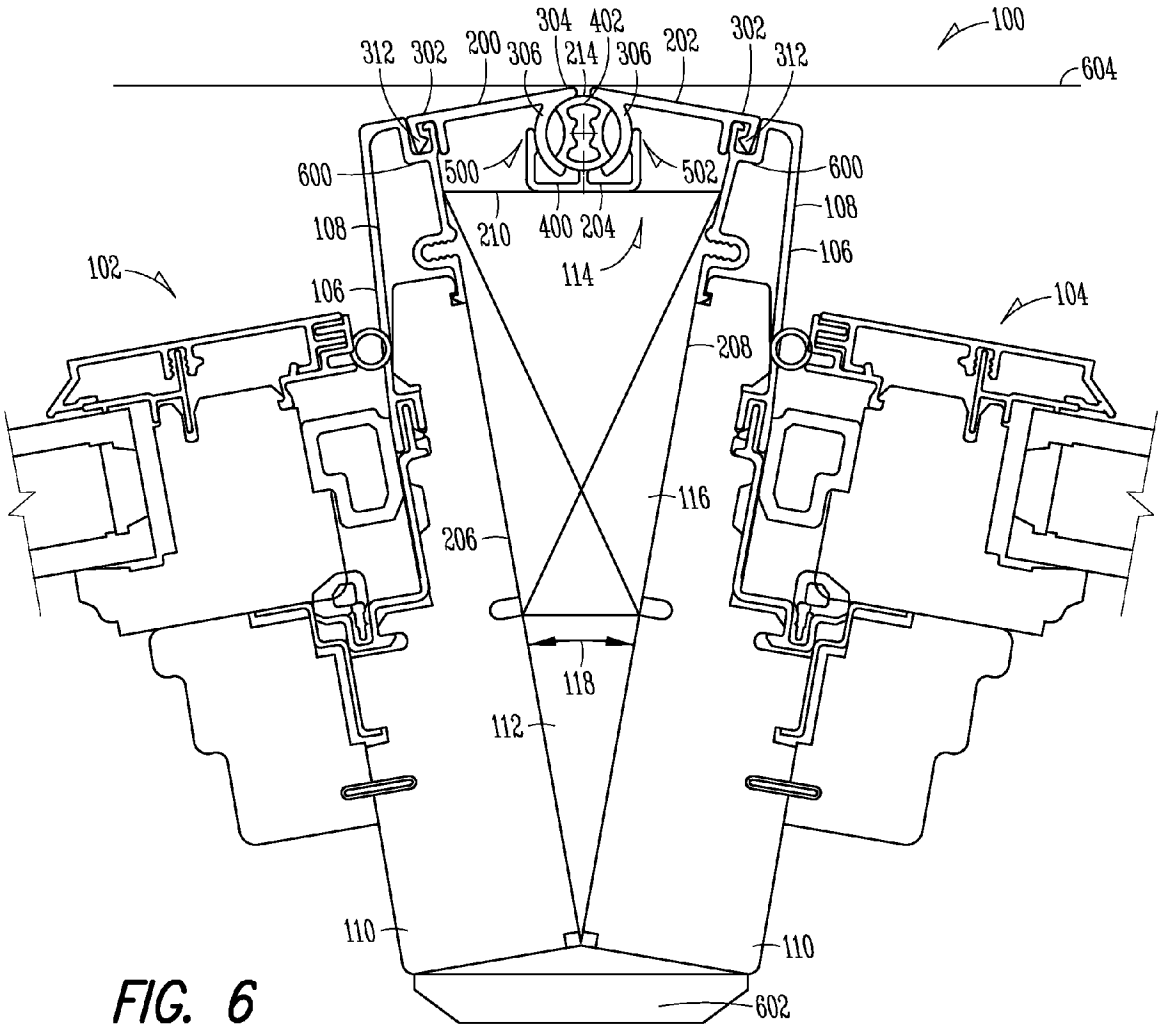
FIG. 6 is a cross sectional view of the window assembly shown in FIG. 1.

FIG. 6 shows the fenestration assembly 100 including first and second windows 102, 104 as previously described and shown in FIGS. 1, 2A and 2B. The fenestration assembly 100 is shown in FIG. 6 in cross-section including the mullion cover linkage 114 coupled between the first and second windows 102, 104. As previously described and shown, for instance, in FIG. 5 the mullion cover linkage 114 includes first and second wings 200, 202 rotatably coupled at the pivot clip 204. The first and second wings 200, 202 are shown coupled across the first and second windows 102, 104, for instance, at frame exterior portions 108 of each of the windows 102, 104. In the example shown, the first and second wings 200, 202 are coupled with the first and second windows 102, 104 with frame fasteners 312. The frame fasteners 312, in one example, include hooks 314 and ridges 316. As shown in FIG. 6, the frame fasteners 312 are respectively coupled with frame couplings 600 provided on each of the window frames 106. The frame couplings 600 and frame fasteners 312 cooperate to couple the mullion cover linkage 114 across the mullion gap 112 provided between the frames 106 of the windows 102, 104.

As previously described, the first and second wings 200, 202 are coupled with the pivot clip 204 to form the mullion cover linkage 114. As shown in FIG. 6, the first and second wings 200, 202 are rotatable relative to the pivot clip 204 and thereby able to deflect into a configuration corresponding to the orientation angle 118 between the frames 106 and the first and second windows 102, 104. For example, the orientation angle 118 of the frames 106 is approximately 20 degrees. The first and second wings 200, 202 are each at an angle of approximately 10 degrees relative to a horizontal line 604 extending across the mullion cover linkage 114, for instance, across the pivot ends 304 of each of the first and second wings 200, 202. The horizontal line is also perpendicular to a line bisecting the orientation angle 118.

In another example, where the orientation angle 118 is at a different angle, for instance 30 degrees, the first and second wings 200, 202 are deflected relative to the horizontal line 604 approximately 15 degrees. In this orientation, the first and second wings 200, 202 continue to span the mullion gap 112. Optionally, the first and second wings 200, 202 include wider wingspans 300. The wider wingspans 300 provide additional width to each of the first and second wings 200, 202 and facilitate the orientation of the first and second wings 200, 202 at the greater angles of 15 degrees corresponding to the orientation angle 118 (where the orientation angle is approximately 30 degrees). As shown in FIG. 6, the first and second wings 200, 202 are rotated relative to the pivot clip 204 at first and second pivot joints 500, 502 formed by the slidable engagement (e.g., slidable clamping, slidable coupling, movable coupling and the like) between the pivot flanges 306 and the opposed surfaces of the clip sockets 406 (such as the first, second and third pivot surfaces 408, 410, 412).

In operation, the fenestration assembly 100 including the first and second windows 102, 104 is oriented according to the orientation angle 118 desired. For instance, the first and second windows 102, 104 are positioned relative to each other with the orientation angle 118 between the frames 106. As shown in FIG. 6, the juncture between the first and second windows 102, 104 occurs at the frame interior portions 110. In this example, the mullion gap 112 tapers from the frame exterior portion 108 to the frame interior portion 110. In another option, the mullion gap 112 tapers from the frame interior portions 110 toward the frame exterior portions 108. The locking block 116 is positioned between the frames 106 as shown in FIG. 6. In one example, the locking block 106 is a precut piece of wood, composite or the like positioned between the frames 106. In another example, the locking block 116 is a preformed piece of material having a set orientation angle corresponding to the orientation angle 118 shown in FIG. 6. That is to say, in one example, the locking block 106 is cut or formed during manufacturing to have a shape corresponding to the orientation angle 118 shown in FIG. 6. After installation of a specified locking block 116 or a cut to fit locking block 116 within the mullion gap 112 the mullion cover linkage 114 is installed across the mullion gap 112 extending between the first and second windows 102, 104. In one example, the first and second wings 200, 202 are already deflected relative to the clip base 204 prior to installation with the frames 106. In another example, installation of the mullion cover linkage 104 including fastening of the frame ends 302 with the frames 106 deflects the first and second wings 200, 202 into the orientations shown in FIG. 6 that correspond to the orientation angle 118. In one example, the engagement of the clip base 400 of the pivot clip 204 with the anchoring face 210 of the locking block 116 provides a structural contact for the pivot clip 204 and provides a fulcrum for rotation of the first and second wings 200, 202 around the pivot clip 204 for engagement with the frames 106. By engaging the first and second wings 200, 202 with the frames 106 and further engaging the pivot clip 204 with the locking block 116 the mullion cover linkage 114 is substantially immobilized relative to the first and second windows 102, 104 and the first and second wings 200, 202 are held at the orientation shown (e.g., for instance, orientations corresponding to the orientation angle 118).

In one option, installation of the mullion cover linkage 114 with the first and second windows 102, 104 further includes applying a sealant along the sealant grooves 416 shown in FIGS. 4A and 4B. Application of the sealant within the sealant grooves 416 provides a tight weatherproof seal between the first and second wings 200, 202 and the pivot clip 204 to substantially prevent the ingress of water, wind and the like through the mullion cover linkage 114 to the interior components of the windows 102, 104. In another example, the fenestration assembly 100 is completely installed when a trim piece such as trim piece 602 is installed across the frame interior portions 110. In one example, the trim piece 602 is a decorative piece of trim tacked onto the frame interior portions 110.

As described herein, the mullion cover linkage 114 provides a fully adjustable and customizable cover (according to deflection of the first and second wings) that pivots around one or more axes according to an orientation angle 118 to fully cover the mullion gap 112. As shown in FIG. 6, the first and second wings 200, 202 each provide a decorative planar appearance with a single continuous shadow line 214 extending between the planes defined by the first and second wings 200, 202. Referring to FIG. 2B, the first and second wings 200, 202 provide a substantially continuous surface across the mullion gap 112 with only the shadow line 214 providing exposure to the pivot clip 204. Further, the mullion cover linkage 114 provides a sealed mullion cover along the full length of the frames 106. In another option, the mullion cover linkage 114 extends long at least a portion of the frames 106.

Further, the cooperative engagement between the locking block 106 and the first and second frame surfaces 206, 208 as well as the engagement between the frame ends 302 of the first and second wings 200, 202 with the frames 106 ensures the first and second wings are positioned at angles that closely match an orientation angle, such as the orientation angle 118 shown in FIG. 6. In one example, the locking block 116 engages with the pivot clip 204 and holds the pivot clip 204 in place and cooperates with the engagement of the frame ends 302 of the first and second wings 200, 202 to hold the first and second wings at identical angles relative to the horizontal line 604. Further, the first and second windows 102, 104 as shown in FIG. 6 are oriented relative to each other with the frame interior portions 110 in contact or adjacent to each other (e.g., with space therebetween). By using the mullion cover linkage 114 the effective pivot point of the first and second windows 102, 104 is moved to one or more pivot axes such as the pivot axis 420 shown in FIG. 4B. By moving the pivot axis of the first and second windows 102, 104 to the exterior of the frame 106 the mullion cover linkage 104 is able to pivot around the same or similar axis as the windows 102, 104 and thereby closely match the orientation angle 118 between the frames 106.

In one example, the mullion cover linkage 114 is constructed with weather resistant and sturdy materials such as Ultrex, vinyl, metals including aluminum, steel, as well as composites and the like and is thereby configured for exposure to environmental conditions (e.g., ultraviolet light, moisture and freezing and high temperatures). The mullion cover linkage 114 provides protection for the interior components of the fenestration assembly 100, for instance, the first and second frame surfaces 206, 208. Correspondingly, the trim piece 602 extending between the frame and interior portions 110 includes decorative pieces such as wooden trim pieces and the like without needing materials configured for exterior use.

As previously described, the mullion cover linkage 114 provides an adjustable mullion cover spanning the mullion gap 112. As described previously and described herein below, the mullion cover linkage 114 including the first and second wings 200, 202 having specified wing spans 300 is configured to span across a variety of orientation angles 118 and mullion gaps 112 having different spacing. As described in the pairs of Figures following, for instance FIG. 7A, B and FIGS. 8A, B, the respective first and second wings having a set width may be oriented at one or more angles relative to first and second windows 102, 104 to provide a single adjustable mullion cover linkage 104 that spans a variety of mullion gaps 112 between the same windows 102, 104. Further, by exchanging the first and second wings with supplemental wings having different wingspans the mullion cover linkage including those supplemental wings is configured for additional coverage including orientation of the first and second wings at greater ranges of angles with different spacing between the first and second windows 102, 104.

Figure 7A:
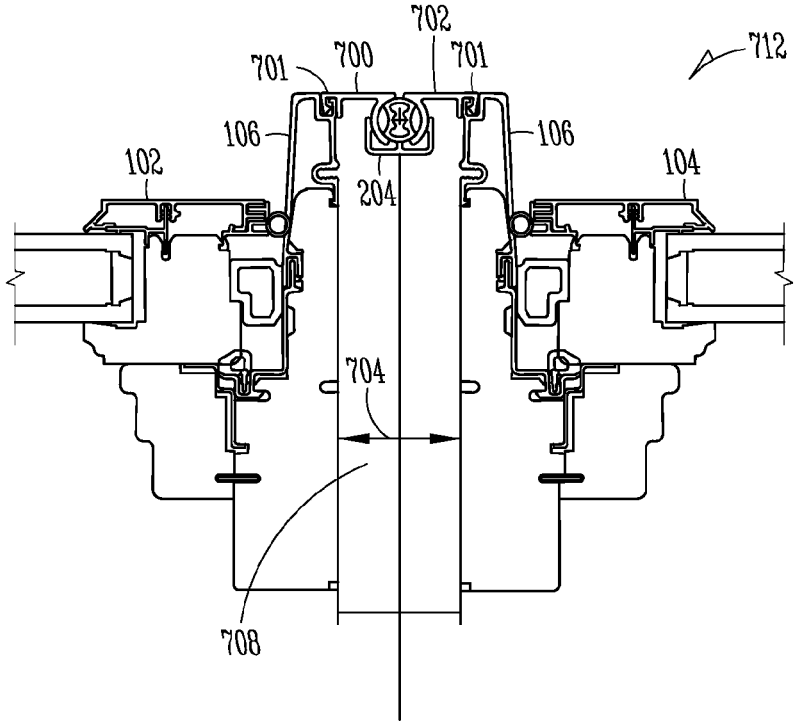
FIGS. 7A, B are cross sectional views of window assemblies with first and second windows at 1 degree and 15 degree angles respectively, with wings having a first width.
Figure 7B:
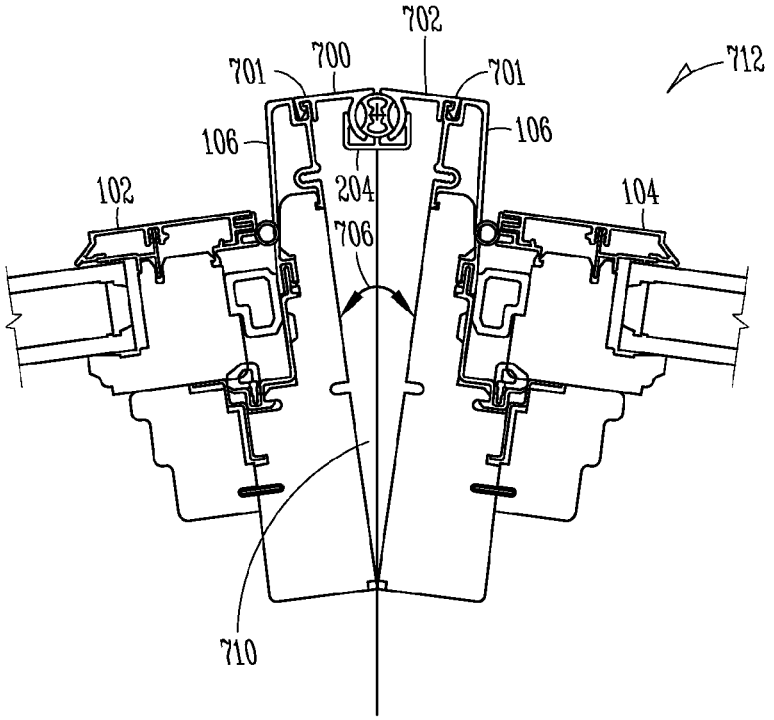

FIGS. 7A and 7B show a mullion cover linkage 712 including first and second wings 700, 702 coupled with the pivot clip 204 previously described herein. As shown in FIGS. 7A and 7B, the first and second wings 700, 702 are positionable relative to the pivot clip 204 through a range of angles, for instance, between 1 and 15 degrees. The first and second wings 700, 702 are positionable relative to the pivot clip 204 through this range of angles according to the wingspan 701 of each of the wings 700, 702. Further, the range of orientation angles 704 the mullion cover linkage 712 covers is further constrained by the depth of the window frames such as the window frames 106. For instance, deeper the window frames allow for a shallower range of orientation angles for the first and second wing 700, 702 based on their wingspans 701.

Referring first to FIG. 7A, the mullion cover linkage 712 is shown positioned across a first mullion gap 708 having a first orientation angle 704 (e.g., approximately 1 degree). As shown, the first and second wing 700, 702 have a substantially planar configuration relative to one another. Stated another way, the first and second wings 700, 702 have a substantially continuous surface across the mullion gap 708. With the first orientation angle 704 at approximately 1 degree the corresponding angles of the first and second wing 700, 702 relative to a horizontal line such as the horizontal line 604 shown in FIG. 6 is approximately 0.5 degrees. The first and second wings 700, 702 are oriented at substantially identical angles according to engagement between the first and second wings 700, 702 and the frames 106. Additionally, engagement of the pivot clip 204, for instance, with a locking block, such as the locking block 116 shown in previous Figures, positions the first and second wing 700, 702 to have substantially identical orientations that correspond with the orientation angle 704.

Referring now to FIG. 7B, the same first and second wings 700, 702 are shown oriented at greater angles relative to each other and the pivot clip 704. For instance, the frames 106 of the first and second windows 102, 104 are positioned with a second orientation angle 706 therebetween. As shown in FIG. 7B, the second mullion gap 710 tapers from near the first and second wings 700, 702 toward a juncture where the first and second frames 106 meet with one another (e.g., at a position similar to the frame interior portions 110 previously described herein). As shown in FIGS. 7A and 7B, the mullion cover linkage 712 is configured for covering the mullion gaps 708, 710 according to rotation of the first and second wing 700, 702. In one example, the first and second wings 700, 702 when used with the frames 106 as shown in FIGS. 7A and 7B are configurable to cover a mullion gap having orientation angles from approximately 1 to 15 degrees. Stated another way, the mullion cover linkage 712 is deflectable across a plurality of mullion gaps such as the first and second mullion gaps 708, 710 including the first and second orientation angles 704, 706 shown herein. The mullion cover linkage 712 is thereby readily configurable across this range of orientation angles and thereby obviates the need for a plurality of separate mullion covers customized to extend across differing mullion gaps with one or more different orientation angles according to the positioning of the first and second windows 102, 104.

Figure 8A:
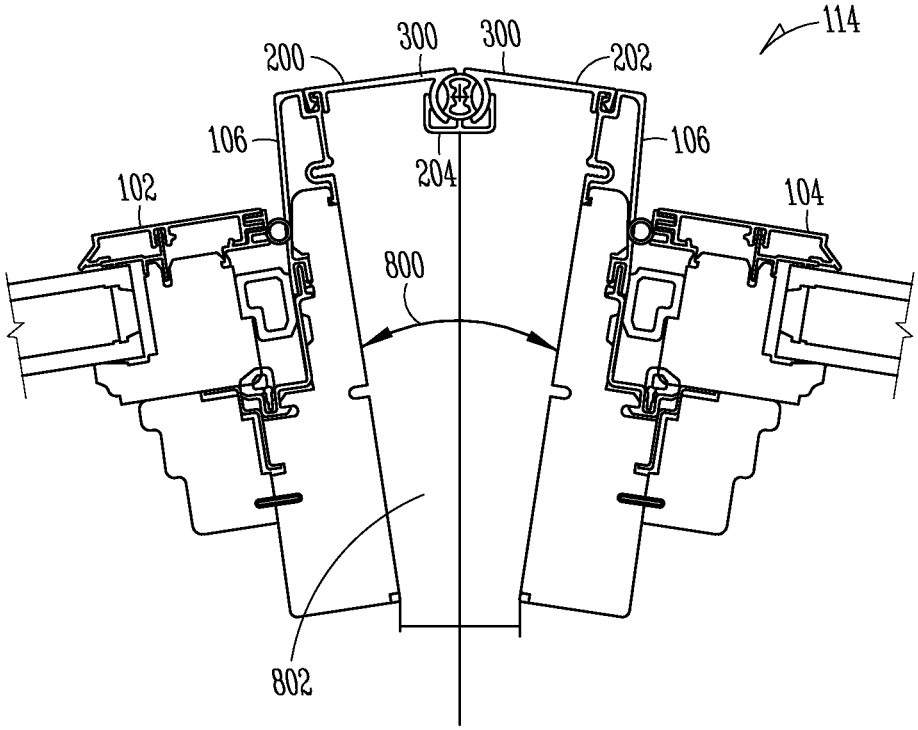
FIGS. 8A, B are cross sectional views of window assemblies with first and second windows at 16 degree and 30 degree angles respectively, with wings having a second width.
Figure 8B:
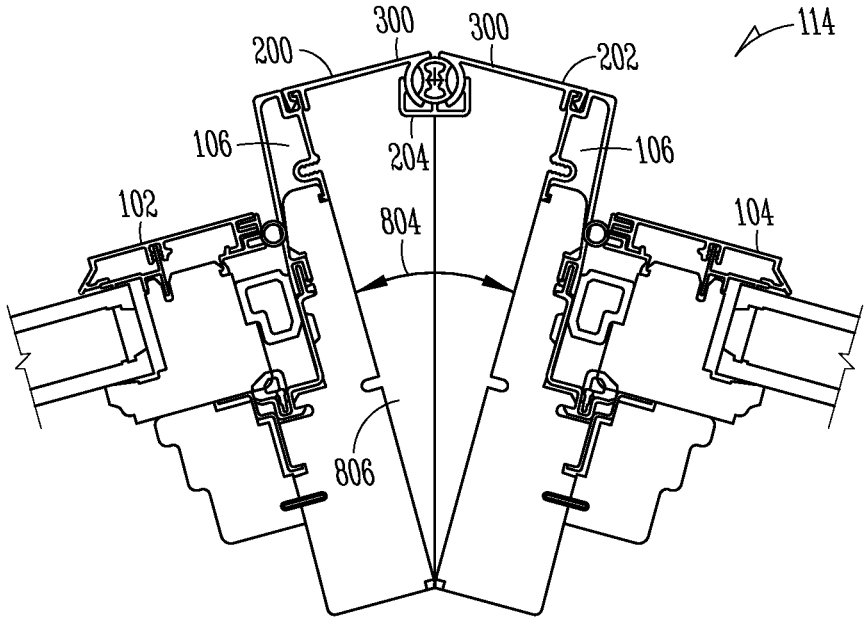

In a similar manner to FIGS. 7A, B, FIGS. 8A and 8B show the mullion cover linkage 114 previously shown herein with the first and second wings 200, 202 coupled with the pivot clip 204. As previously described, the mullion cover linkage 114 is deflectable (e.g., the wings are rotatable relative to the pivot clip 204) to provide a flexible linkage capable of covering a plurality of mullion gaps such as the third and fourth mullion gaps 802, 806 and the corresponding third and fourth orientation angles 800, 804 shown respectively in FIGS. 8A and 8B. In one example, the first and second wings 200, 202 are sized and shaped to extend across a plurality of mullion gaps having corresponding orientation angles measured from 1 to 30 degrees approximately. In another example, the first and second wings 200, 202 are used in place of the wings 700, 702 shown in FIG. 7A, 7B where the orientation angle of the first and second windows 102, 104 is between the range of approximately 16 and 30 degrees. Stated another way, the first and second wings 700, 702 may be used with orientation angles of approximately 1 to 15 degrees where a mullion cover linkage 712 having a smaller profile (e.g., width) based on the wingspans 701 is desired as opposed to using the larger profile according to the wingspans 300 of the first and second wings 200, 202.

Figure 9A:
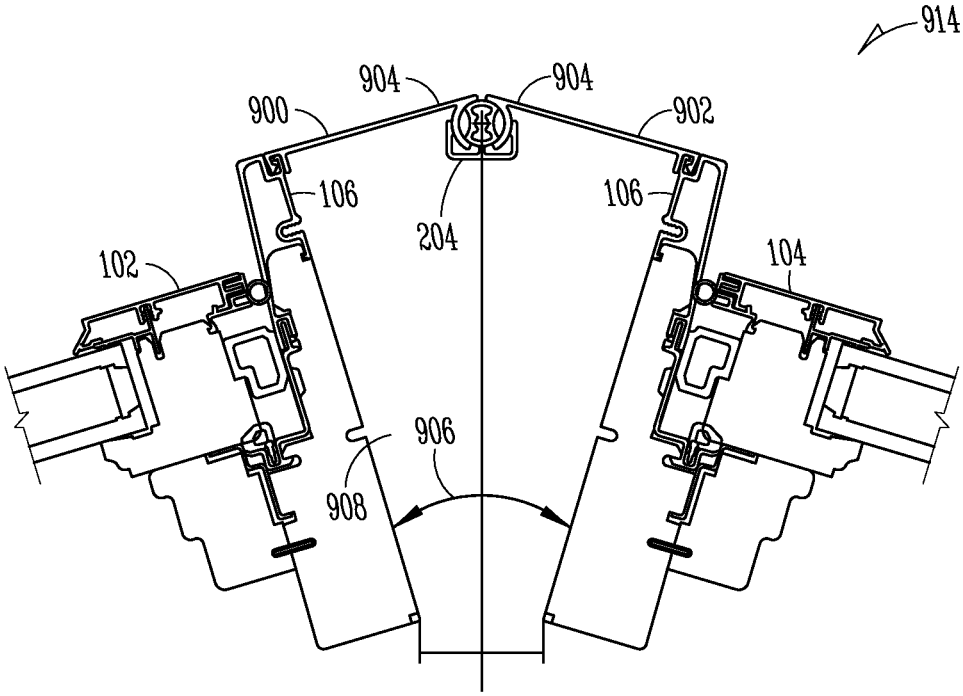
FIGS. 9A, B are cross sectional views of window assemblies with first and second windows at 31 degree and 45 degree angles respectively, with wings having a third width.
Figure 9B:
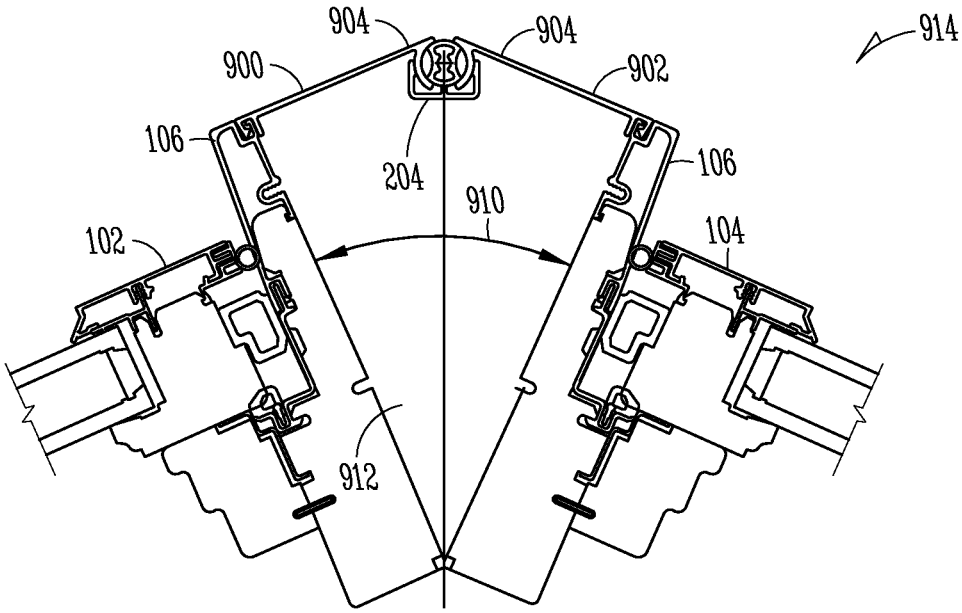

FIGS. 9A and 9B show yet another example of a mullion cover linkage 914 including first and second wings 900, 902 coupled with the pivot clip 204. In a similar manner to the previously described mullion cover linkages the mullion cover linkage 914 is configured to extend across a plurality of mullion gaps with a variety of orientation angles. Referring first to FIG. 9A, the mullion cover linkage 914 is shown in a deflected configuration extending across a fifth mullion gap 908 having a fifth orientation angle 906. In another example, the mullion cover linkage 914 is shown extending across the sixth mullion gap 912 according to the sixth orientation angle 910. In one example, the fifth and sixth orientation angles 906, 910 correspond to angle measurements of approximately 31 and 45 degrees, respectively. As shown in FIG. 9B, the first and second wings 900, 902 are deflected at greater angles relative to a horizontal line, such as the line 604 shown in FIG. 6, compared to the orientation of the wings 900, 912 in FIG. 9A. The first and second wings 900, 902 have equivalent angles of approximately 15.5 degrees each relative to the fifth orientation angle 906 of approximately 31 degrees.

As shown in FIGS. 9A and 9B, the first and second wings 900, 902 with the wingspans 904 have greater widths than either of the wings 700, 702 and 200, 202 to provide a greater range of angles the first and second wings 900, 902 may rotate through assuming the frames 106 have an identical depth to the previously discussed assemblies shown in FIGS. 7A through 8B. As similarly described with previous wings, the first and second wings 900, 902, when coupled with the pivot clip 204 to form the mullion cover linkage 914, are also equally usable with orientation angles less than approximately 31 degrees. For instance, the mullion cover linkage 914 may be used equally well with orientation angles measuring from 1 to 30 degrees in a similar manner to the first and second wings 200, 202 of the mullion cover linkage 114.

Figure 10A:
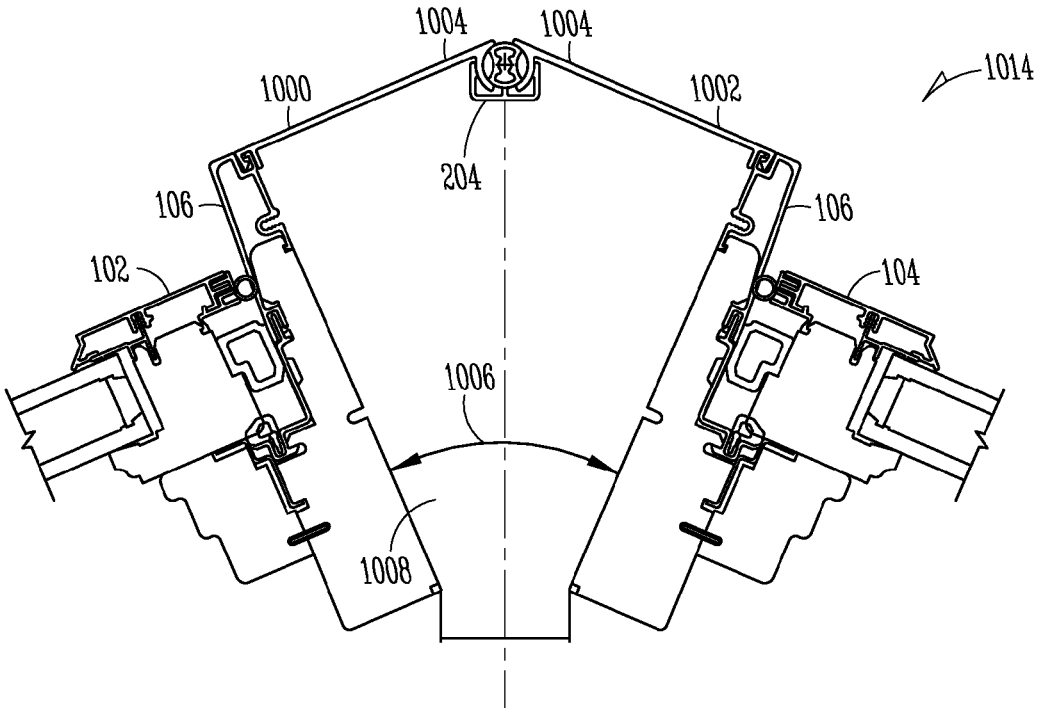
FIGS. 10A, B are cross sectional views of window assemblies with first and second windows at 46 degree and 60 degree angles respectively, with wings having a fourth width.
Figure 10B:
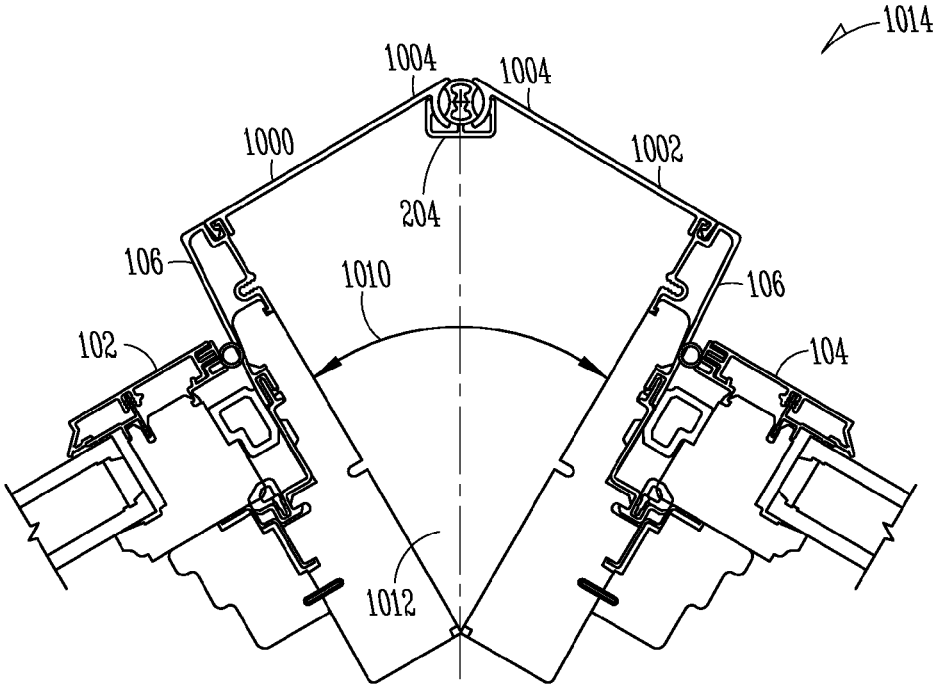

FIGS. 10A and 10B show yet another example of a mullion cover linkage 1014 extending across mullion gaps positioned between the first and second windows 102, 104. The first and second wings 1000, 1002 have the largest wingspan 1004 of the wings previously described herein. Similarly, the first and second wings 1000, 1002 are positionable at a range of angles greater than that provided with the previously described wings (e.g., where the frames 106 have an identical depth to the frames used in the previously described assemblies). For instance, as shown in FIGS. 10A and 10B the mullion cover linkage 1014 is positioned across seventh and eighth mullion gaps 1008, 1012 having corresponding orientation angles 1006, 1010. In one example, the first and second wings 1000, 1002 are deflected relative to the pivot clip 204 into an orientation as shown in FIG. 10A where the first and second wings have corresponding angles to the seventh orientation angle 1006, for instance an angle measure of approximately 46 degrees (e.g., the wings thereby have equivalent angles of approximately 23 degrees each). The first and second wings 1000, 1002 in FIG. 10B are shown at greater equivalent angles relative to those shown in FIG. 10A, for instance, the eighth orientation angle 1010 corresponds to an angle measure of approximately 60 degrees and the first and second wings 1000, 1002 are oriented relative to a horizontal line, such as the line 604 shown in FIG. 6, at approximately 30 degrees each. As previously described with the other exemplary wings herein the first and second wings 1000, 1002 may also be used at angles less than those shown in FIGS. 10A and 10B, for instance, angles measuring between 1 and 45 degrees.

Where any of the first and second wings described herein are used with window frames 106 that are deeper than those shown in FIGS. 7A through 10B, the range of angles available for deflection of the wings relative to a horizontal line such as the line 604 shown in FIG. 6 will be diminished. Stated another way, with deeper frames 106 if greater orientation angles between the windows 102, 104 are desired wings having greater wingspans such as wingspans 300, 904 and 1004 are used to ensure the respective mullion cover linkages readily extend across the mullion gaps having the orientation angles used with the deeper frames 106. Conversely, where greater orientation angles are required with the first and second windows 102, 104 wider first and second wings 200, 202, 900, 902 and 1000, 1002 are used to provide corresponding mullion cover linkages configured to extend across the greater angles relative to, for instance, the smaller first and second wings 700, 702 included in the mullion cover linkage 712.

The mullion cover linkage as described herein including, for instance, the pivot clip 204 and the one or more sizes of standardized wings provide a flexible system and linkage that covers a variety of mullion gaps and orientation angles according to the varying depths of the frames 106 as well as the desired orientation angles between the windows 102, 104. Where greater orientation angles are desired between the windows 102, 104 or the frames 106 are deeper relative to corresponding shallow window frames, first and second wings having greater wingspans are used with the mullion cover linkages. Conversely where smaller orientation angles are required or shallower frames 106 are used the smaller wings such as first and second wings 700, 702 or first and second wings 200, 202 are used though the larger wings 900, 902 and 1000, 1002 are equally useful within the smaller orientation angles as well. The mullion cover linkages described herein including the first and second wings provide an adjustable and flexible system including deflectable wings that cover a range of angles and mullion gaps for each wingspan width. The mullion cover linkages described herein minimize the number of parts needed and further eliminate the need for the production of customized mullion covers for positioning between windows such as windows 102, 104 positioned at a variety of orientation angles, for instance, orientation angles measuring from 1 to 60 degrees. The pivot clip 204 described herein remains consistent throughout each of the mullion cover linkages, further, the first and second wings used in any of the embodiments shown in FIG. 7A through 10B are produced in one example at standardized widths (e.g., wingspans) and are thereafter adjustable when coupled with the pivot clip 204 to provide a mullion cover linkages that are configurable to cover a variety of mullion gaps and orientation angles between the windows 102, 104. Stated another way, the installer is able to configure each of the mullion cover linkages into a unique configuration corresponding to the desired orientation angles and spacing of the mullion gaps between the windows 102, 104 (or doors) through deflection of the wings relative to the pivot clip 204. The flexible nature of the mullion cover linkages described herein eliminates the need for specialized unique covers because the linkages are deflectable and configurable and thereby adjust to the orientation angle and spacing of the mullion gaps needed for the windows no matter what orientation angle or spacing is provided between the windows 102, 104 (subject to the depth of the window frames 106).

Figure 11:
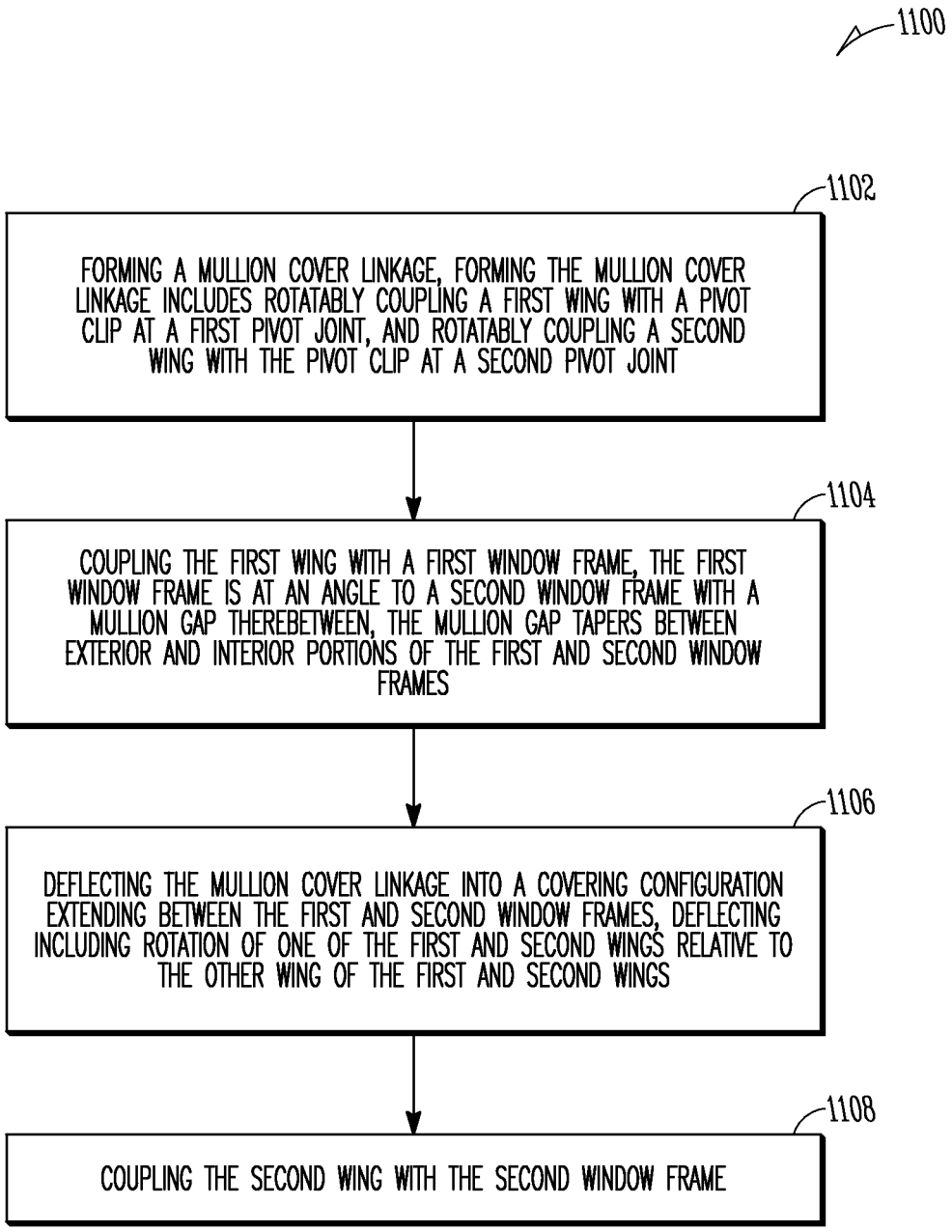
FIG. 11 is a block diagram showing one example of a method for using a mullion cover linkage.

FIG. 11 is a block diagram showing one example of a method 1100 of using a mullion cover linkage, such as the mullion cover linkage 114 previously described herein. While describing the method 1100 reference is made to features and elements previously described herein. Where appropriate reference numbers are provided for elements that are previously discussed and shown in the figures. The reference numbers provided are not intended to be limiting. Instead, terminology used is intended to include all similar subject matter within the application as well as their equivalents. At 1102, a mullion cover linkage 114 is formed. Formation of the mullion cover linkage 114 includes rotatably coupling a first wing 200 with a pivot clip 204 at a first pivot joint 500. Forming the mullion cover linkage 114 further includes rotatably coupling a second wing 202 with the pivot clip 204 at a second pivot joint 502. In one example, the first and second pivot joints are rotatable around a single axis such as a pivot access extending through the pivot clip 204 near a center of the pivot clip. In another example, the first and second pivot joints 500, 502 rotate around different pivot axes spaced apart along portions of the pivot clip 204. In one example, rotatable coupling of the first and second wings 200, 202 includes slidable engagement of pivot flanges of the first and second wings between opposed pivot surfaces of the pivot clip 204. Slidable engagement of the pivot flanges slidably clamps the first and second wings 200, 202 with the pivot clip 204 and facilitates rotation of the first and second wings 200, 202 relative to the pivot clip 204 while the engagement between the pivot clip and the wings snugly holds the first and second wings in place when positioned at an angle relative to the pivot clip 204, for instance, as shown in FIG. 2A.

At 1104, the method 1100 further includes coupling the first wing 200 with the first window frame 106 of a first window 102. The first window frame 106 is at an angle, such as an orientation angle 118, to a second window frame 106 used with a second window 104. The mullion gap 112 is formed between the first and second windows 102, 104. In one example, the mullion gap 112 extends an identical angle relative to the orientation angle 118. In another example, the mullion gap 112 tapers between the exterior and interior portions of the first and second window frames 106 as shown in FIGS. 1 and 2A.

At 1106, the mullion cover linkage 114 is deflected into a covering configuration extending between the first and second window frames 106. In one example, deflecting the linkage 114 includes deflection of one of the first and second wings 200, 202 relative to the other wing 202, 200 of the first and second wings. Stated another way, the first wing 200 is rotated relative to the second wing 202 through the slidable engagement of the first wing with the pivot clip 204. Optionally, both of the first and second wings 200, 202 are rotated relative to the pivot clip 204 and thereby are rotated relative to each other. One example of the mullion cover linkage 114 and the covering configuration is shown in FIGS. 2A and 2B, previously described herein.

At 1108, the method further includes coupling of the second wing 202 with the second window frame 106. In one example, the mullion cover linkage 114 including frame ends for each of the first and second wings 200, 202 is coupled with exterior portions of the first and second frames 106. The pivot axis for the first and second wings and the mullion cover linkage 114 is thereby positioned adjacent to the exterior portions 108 of the first and second windows 102, 104. In another example, the mullion cover linkage 114 is coupled between the frame interior portions 110 of the first and second windows 102, 104. In such an example, the pivot axis of the mullion cover linkage 114 is positioned adjacent to the frame interior portion. In another example, coupling of the first and second wings with respective exterior portions of the first and second window frames (e.g., the first and second windows 102, 104) includes covering the mullion gap 112 with a mullion cover linkage 114. That is to say, the mullion cover linkage 114 extends along at least a part of the window frames 106 of the first and second windows 102, 104. Optionally, the mullion cover linkage 114 extends the length of the frames 106 of the first and second windows 102, 104 and thereby provides a continuous covering for the entire mullion gap 112 between the first and second windows 102, 104.

Several options for the method 1100 follow. In one example, the method 1100 includes positioning a locking block 116 between the first and second window frames 106. For instance, the locking block includes opposed surfaces sized and shaped to engage with frame surfaces 206, 208. The method 1100 further includes engaging and anchoring face 210 of the locking block 116 with the pivot clip 204 (e.g., along a clip base 400). The engagement of the anchoring phase 118 with the pivot clip 204 immobilizes the pivot clip 204 relative to the first and second window frames 106 of the first and second windows 102, 104. In yet another example, engaging the anchoring face 118 of the locking block 116 with the pivot clip 204 holds the first and second wings 200, 202 in substantially identical orientations relative to the pivot clip 204. Stated another way, and as previously described herein, as shown in FIG. 6, a line 604 such as a horizontal line extending through the pivot ends of the first and second wings 200, 202 is substantially perpendicular to a center line extending through the orientation angle 118. Engagement between the locking block 116 and the pivot clip 204 as well as the coupling of the first and second frame ends of the first and second wings 200, 202 orients each of the first and second wings into substantially identical configurations relative to the line 604. For instance, the first and second wings are at angles relative to the line 604 that correspond to the orientation angle 118. In one example, where the orientation angle 118 is 30 degrees, the first and second wings because of the engagement between the locking block 116 and the frames 106 are positioned at approximately half of the angle of the orientation angle relative to the line 604 (e.g., 15 degrees relative to the line 604). Optionally, the first and second wings maintain a corresponding relationship with the orientation angle 118, for instance, the first and second wings are consistently measured at an angle relative to the lines 604 equivalent to approximately half of the orientation angle 118.

In another example, the method 1100 includes one or more of rotatably coupling the first or second wings 200, 202 with the pivot clip 204 including, for instance, movably positioning a pivot flange 300 within a clip socket of the pivot clip 204. In another example, movably positioning the pivot flange 300 within the clip socket includes slidably clamping the pivot flange 300 between opposed pivot surfaces (e.g., surfaces 408, 410, 412) of the pivot clip 204. Optionally, slidably clamping the pivot flange 300 includes slidably engaging the first and second pivot surfaces 408, 410 of the pivot clip 204 along a first face of the pivot flange 300. The third pivot surface 412 is slidably engaged along a second phase of the pivot flange 300 opposed to the first phase. The third pivot surface 412 is between the first and second pivot surfaces 408, 410. Stated another way, the first, second and third opposed pivot surfaces 408, 410, 412 engage in opposed three point engagement with the pivot flange of one or more of the first and second wings 200, 202. Engagement of the pivot surfaces with the pivot flange of one or more of the first and second wings 200, 202 slidably couples the first and second wings 200, 202 with the pivot clip 204 while snugly retaining the first and second wings 200, 202 in whatever orientation the wings are rotated into relative to the pivot clip 204. In another option, the method 1100 includes applying a sealant within a sealant groove 416 extending along the pivot clip 204. The sealant is positioned between one or more of the first and second wings 200, 202 and the pivot clip 204. The sealant provides a seal that prevents the ingress of moisture, air and the like through the mullion cover linkage 114. Additionally, in another example, a sealant cooperates with the first and second wings 200, 202 and the pivot clip 204 to immobilize the first and second wings 200, 202 in whatever orientation they are set during installation with the first and second windows 102, 104.

In still another example, the method 1100 includes selecting the first and second wings having a first width (e.g., wingspan) from a plurality of wings having a plurality of widths including the first width and other differing widths. In one example, a plurality of wings having differing wingspans (e.g., widths) is shown in FIGS. 7A through 10B. As previously described, the first and second wings are selected according to the depth of the window frames 106 of the first and second windows 102 and the orientation angle 118 between the first and second windows 102, 104. For instance, where greater orientation angles or deeper frames 106 are used larger wings are selected to ensure the mullion cover linkage 104 is capable of deflection across the mullion gap 112 and is further able to cover the mullion gap. Conversely, with smaller orientation angles or shallower frames 106 for the first or second windows 102, 104 smaller wings with relatively smaller wingspans may be used. Alternatively, larger wings such as the wings shown in FIGS. 9A, 9B, 10A, 10B may be used with smaller orientation angles or shallower frames 106. Where larger wings are used with smaller orientation angles and shallower frames 106 the mullion cover linkage 114 will present a larger profile relative to the windows 102, 104 than otherwise presented with smaller wings such as the wings 200, 202 shown in FIGS. 8A and 8B.

Figure 12:
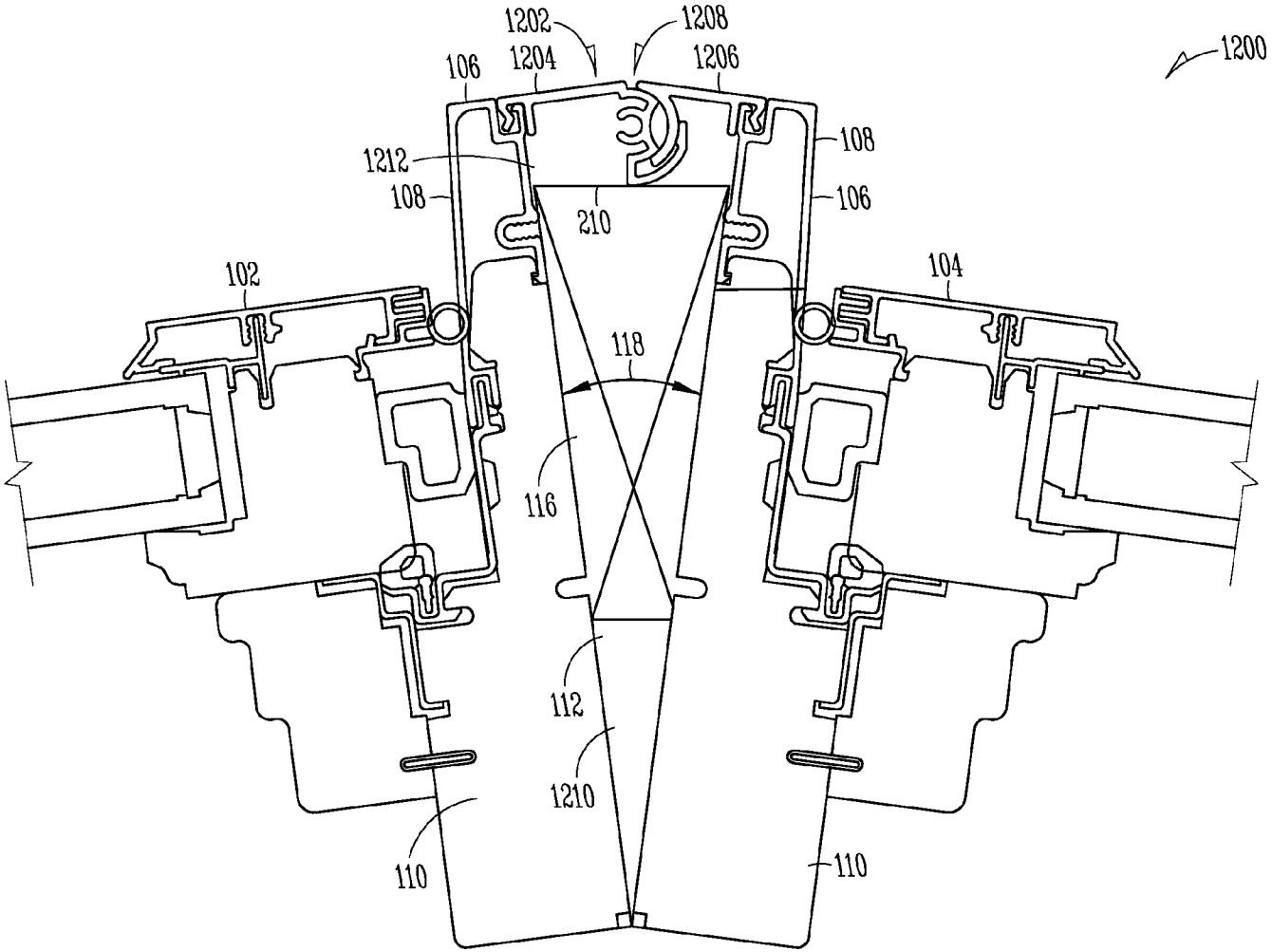
FIG. 12 is a cross sectional view of a window assembly including another example of a mullion cover linkage.

FIG. 12 is a cross-sectional view of another example of a window assembly 1200 including first and second windows 102, 104. As shown in FIG. 12, a mullion cover linkage 1202 spans a mullion gap 112. As shown in FIG. 12, the mullion gap 112 extends from a gap end 1210 to a gap base 1212. The mullion gap 112 tapers from the gap end 1210 to the gap base 1212 according to the orientation angle 118. The mullion cover linkage 1202 spans the mullion gap 112, for instance, across the gap base 1212 according to deflection of first and second wings 1204, 1206 through the operation of a rotatable joint 1208 positioned therebetween. In one example, the rotatable joint 1208 includes a hinge joint, for instance, formed by integral pieces of each of the first and second wings 1204, 1206 rotatably coupled with each other. As further shown in FIG. 12, the window assembly 1200, in another example, includes a locking block 116 positioned within the mullion gap 112. As shown the locking block 116 is engaged with opposed surfaces of the first and second window frames 106. As previously described and described hereinbelow again, the locking block 116 cooperates with the mullion cover linkage 1202 to substantially immobilize the mullion cover linkage 1202 and thereby retain the mullion cover linkage 1202 in the orientation spanning the mullion gap, for instance, at the gap base 1212 while the first and second wings 1204, 1206 are at relative angles that measure approximately half of the orientation angle 118 (for instance, relative to a horizontal line perpendicular to a bisecting line passing through the orientation angle 118).

As will be described in further detail below, the mullion cover linkage 1202 includes first and second wings 1204, 1206. The rotatable joint 1208 formed between the first and second wings 1205, 1206 is integral to the first and second wings 1204, 1206. The mullion cover linkage 1202 is thereby constructed with a two-piece assembly as opposed to the three-piece assembly previously described herein.

Figure 13:
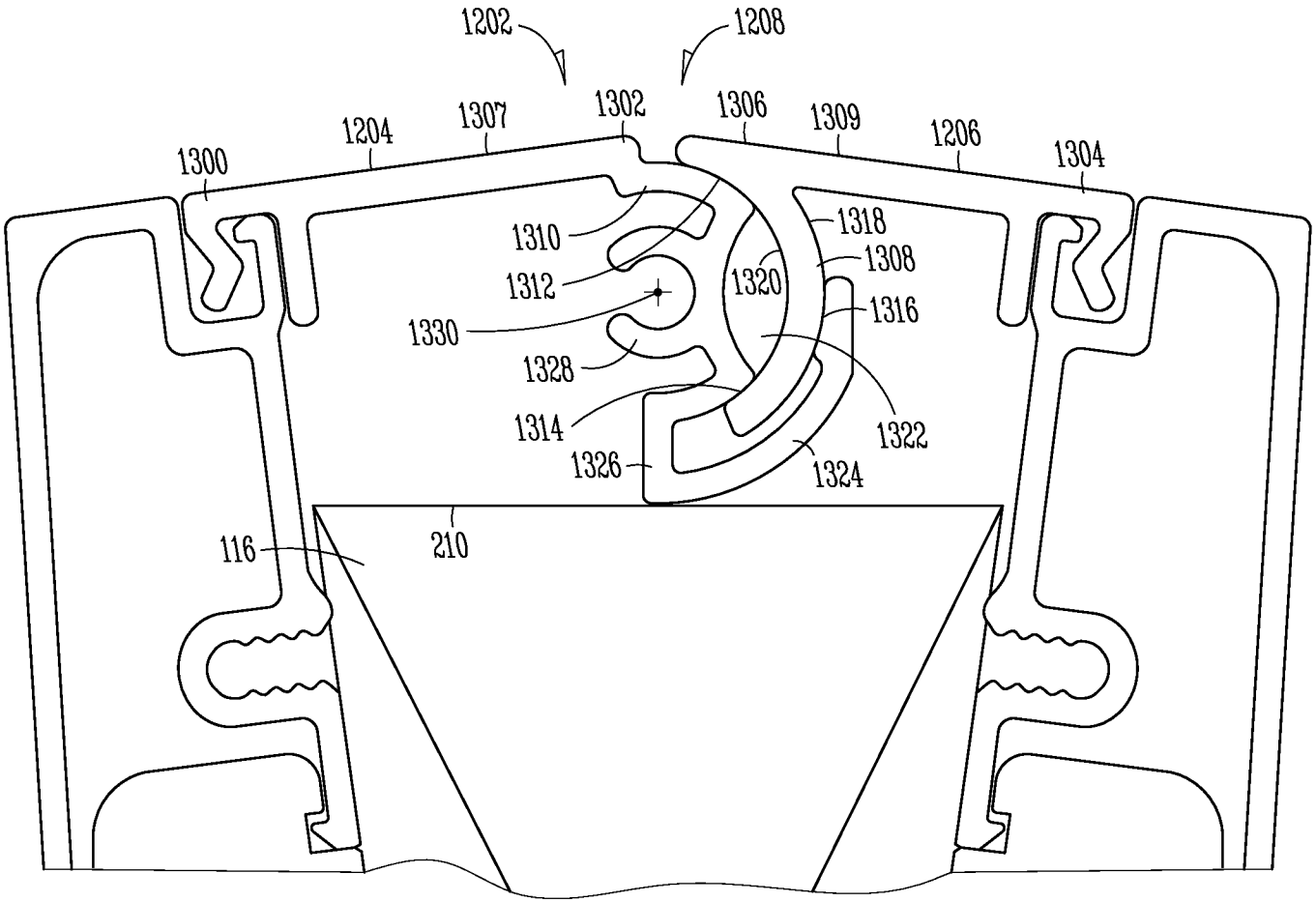
FIG. 13 is a cross sectional view of the mullion cover linkage of FIG. 12.

Referring now to FIG. 13, the mullion cover linkage 1202 is shown in an assembled configuration with the first and second wings 1204, 1206 coupled at the rotatable joint 1208. As with the previously described first and second wings, the first and second wings 1204, 1206 include opposed frame and pivot ends. The first wing 1204 includes a first frame end 1300 and a first pivot end 1302. A wingspan 1307 of the first wing 1204 extends between the first frame end and the first pivot end 1300, 1302. In a similar manner, the second wing 1206 includes a second frame end 1304 and a wingspan 1309 extending from the second frame end 1304 to a second pivot end 1306. The first and second wingspans 1307, 1309 provide the exterior surface to the mullion cover linkage 1202. As previously described in other examples, the mullion cover linkage 1202 provides an aesthetically pleasing exterior surface that conceals the mullion gap 112 while at the same time providing an adjustable linkage capable of spanning a plurality of mullion gaps having correspondingly different orientation angles 118.

Referring again to FIG. 13, the mullion cover linkage 1202 includes a pivot flange 1308 and a corresponding pivot clip 1310. As shown in FIG. 13, the pivot flange 1308 is associated with (e.g., integral to) the second wing 1206. The pivot clip 1310 is associated with (e.g., integral) to the first wing 1204. The pivot flange 1308 is movably coupled with the pivot clip 1310. The first and second wings 1204, 1206 are thereby rotatably coupled at the rotatable joint 1208. As shown, for instance in FIG. 13, the first and second wings 1204, 1206 are sized and shaped for pivoting around the pivot axis 1330 extending through the pivot clip 1310. In one example, the pivot flange 1308 is slidably engaged with opposed pivot surfaces of the pivot clip 1310. For instance, in the example shown in FIG. 13, the pivot clip 1310 includes first and second pivot surfaces 1312, 1314 as part of the pivot bar 1328. A third pivot surface 1316 is provided on a clip arm 1324 extending from a clip base 1326. As shown in FIG. 13, the clip base 1326 is provided between the clip arm 1324 and the pivot bar 1328. By engaging the pivot flange 1308 with the opposed pivot surfaces the pivot flange 1308 is slidably clamped within the pivot clip 1310. The second wing 1206 is thereby able to freely rotate relative to the first wing 1204 at the rotatable joint 1208 while at the same time being snugly engaged and thereby held in a desired configuration, for instance, at an angle corresponding to the orientation angle 118 (see FIG. 12) where the mullion cover linkage 1202 spans the mullion gap 1212, for instance, the gap base 1212. As shown, for instance in FIG. 13, the pivot flange 1308, in one example, includes a first flange face 1318 sized and shaped for engagement with the third pivot surface 1316. A second flange face 1320 of the pivot flange 1308 is sized and shaped for engagement with the first and second pivot surfaces 1312, 1314. The pivot flange 1308 is thereby engaged in slidable coupling with three pivot surfaces of the pivot clip 1310.

In operation, in one example, the second wing 1206 is coupled with the first wing 1204. For instance, the pivot flange 1308 is snapped into the coupling configuration shown in FIG. 13 by passing the pivot flange 1308 between the third pivot surface 1316 and the second pivot surface 1314. Optionally, snapping the pivot flange 1308 in place engages the second flange face 1320 with the first pivot surface 1312 thereby ensuring slidable three point engagement of the pivot flange 1308 therebetween. When assembled the mullion cover linkage 1202 is provided in a first configuration, for instance, where the first and second wings 1204, 1206 are at an angle relative to each other. The user then deflects one of the wings 1204, 1206 relative to the other of the wings 1206, 1204. For instance, the user deflects the mullion cover linkage 1202 into a second configuration having a second angle differing from the first angle in the first configuration. In one example, the second angle corresponds to the orientation angle 118 of the mullion gap 112. The mullion cover linkage 1202 is thereafter coupled with the first and second window frames 106 as shown in FIG. 12. For instance, the first and second frame ends 1300, 1304 are engaged with corresponding features on the first and second frames 106. While the mullion cover linkage 1202 is positioned in the second configuration of the second angle with first and second wingspans 1307, 1309 the mullion cover linkage 1202 is sized and shaped to span the mullion gap 112, for instance, the gap base 1212 and thereby conceal the mullion gap 112.

In another example, the first and second windows 102, 104 shown in FIG. 12, include headers and sills and the pivot flange 1308 and the pivot clip 1310 are continuously engaged from the headers of the first and second windows 102, 104 to the sills of the first and second windows. The continuous engagement of the pivot flange 1308 with the pivot clip 1310 seals an interior of the window assembly, for instance, the mullion gap 112 and the components of the frames 106 therein from an exterior of the window assembly 1200 (e.g., the exterior facing portions of the first and second windows 102, 104). Further, in another example, the mullion cover linkage 1202 includes a sealant groove 1322, for instance, formed in the pivot clip 1310. As with previous examples, a sealant is applied along the sealant groove 1322 prior to assembly of the first and second wings 1204, 1206 at the rotatable joint 1208. The sealant provides a supplemental seal between the pivot flange 1308 and the pivot clip 1310. Additionally, the sealant applied within the sealant gap 1322 further immobilizes the first and second wings 1204, 1206 against further rotation around the rotatable joint 1208. In still another example, the locking block 116 including an anchoring face 210 is provided within the mullion gap 112. The locking block 116 is sized and shaped to engage with the sides of the first and second window frames 106. The anchoring face 210 of the locking block 116 is sized and shaped to engage with the clip base 1326 and provide supplemental support to the mullion cover linkage 1202. The locking block 116 thereby assists in ensuring the first and second wings 1204, 1206 are held statically after engagement with the locking block and coupling with the first and second window frames 106.

CONCLUSION

The mullion cover linkage and the methods for using the same described herein provide an adjustable system that eliminates the need for customized mullion covers. Instead, the mullion cover linkage is fully adjustable through deflection of one or both of the first and second wings to cover a variety of mullion gaps and orientation angles. The mullion cover linkage thereby saves on expensive and time consuming customized parts that are used with extruded and molded mullion covers from mullion gaps that fall outside of standardized sizes and angles. The mullion cover linkage thereby provides a system that is equally configurable to work with standard and non-standard mullion gaps and orientation angles.

Additionally, the mullion cover linkage positions the pivot point between the first and second windows (or doors) of a fenestration assembly with the pivot point of the linkage being the pivot between the first and second windows. Positioning of the pivot point coincidentally with the deflectable mullion cover linkage moves the pivot location to the mullion cover linkage were adjustments can be made through rotation of one or more of the first and second wings to ensure the mullion cover linkage covers the mullion gap. Additionally, by using the deflectable mullion cover linkage the installer uses a standard trim piece across the other side of the mullion gap, for instance, near the framed interior portions. Stated another way, during installation the mullion cover linkage is used along with the standardized trim piece to fully conceal the mullion gap according to the orientation angle between the first and second windows. Conversely the installer does not have to use a customized mullion cover with an otherwise standardized trim piece. Use of customized and unique pieces as mullion covers is thereby eliminated through the use of the mullion cover linkage.

Additionally, the mullion cover linkage covers the mullion gap with the first and second wings decoratively. As previously stated, the first and second wings are deflectable relative to the pivot clip to cover a variety of mullion gaps and orientation angles. Wingspans of the first and second wings present planar components that thereby provide a substantially continuous and planar mullion cover. A shadow line is presented between the first and second wings because of the rotatable coupling with the pivot clip (separate or integral to one of the wings). The shadow line provides a minimal break to the otherwise continuous appearance of the mullion cover linkage and at the same time substantially conceals the pivot clip therein. Additionally, the adjustable (rotational) capability of the mullion cover linkage allows for the close matching of the first and second wings to the orientation of the windows. For instance, the first and second wings are positioned at angles around half the measure of the orientation angle. Stated another way, in one example where the orientation angle of the first and second windows is at 40 degrees the first and second wings are positioned relative to a line substantially perpendicular with a midline of the orientation angle at approximately 20 degrees each. The first and second wings thereby present identical or substantially identical orientations relative to each other when installed with the first and second windows. Additionally, the locking block ensures the first and second wings are identically positioned which further enhances the aesthetical appeal of the mullion cover linkage. For instance, the locking block engages with a portion of the pivot clip and the wings being engaged with the corresponding first and second windows are positioned through these engagements at substantially identical orientations.

In the foregoing description, the subject matter has been described with reference to specific exemplary examples. However, it will be appreciated that various modifications and changes may be made without departing from the scope of the present subject matter as set forth herein. The description and figures are to be regarded in an illustrative manner, rather than a restrictive one and all such modifications are intended to be included within the scope of the present subject matter. Accordingly, the scope of the subject matter should be determined by the generic examples described herein and their legal equivalents rather than by merely the specific examples described above. For example, the steps recited in any method or process example may be executed in any order and are not limited to the explicit order presented in the specific examples. Additionally, the components and/or elements recited in any apparatus example may be assembled or otherwise operationally configured in a variety of permutations to produce substantially the same result as the present subject matter and are accordingly not limited to the specific configuration recited in the specific examples.

Benefits, other advantages and solutions to problems have been described above with regard to particular examples; however, any benefit, advantage, solution to problems or any element that may cause any particular benefit, advantage or solution to occur or to become more pronounced are not to be construed as critical, required or essential features or components.

As used herein, the terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present subject matter, in addition to those not specifically recited, may be varied or otherwise particularly adapted to specific environments, manufacturing specifications, design parameters or other operating requirements without departing from the general principles of the same.

The present subject matter has been described above with reference to examples. However, changes and modifications may be made to the examples without departing from the scope of the present subject matter. These and other changes or modifications are intended to be included within the scope of the present subject matter, as expressed in the following claims.

It is to be understood that the above description is intended to be illustrative, and not restrictive. Many other examples will be apparent to those of skill in the art upon reading and understanding the above description. It should be noted that examples discussed in different portions of the description or referred to in different drawings can be combined to form additional examples of the present application. The scope of the subject matter should, therefore, be determined with reference to the appended claims, along with the full scope of equivalents to which such claims are entitled.

What is claimed is:

1. A mullion cover linkage assembly comprising:

a first wing including a first wing span extending from a first wing frame end to a first wing pivot end, the first wing frame end is configured for coupling with a first window frame, and the first wing includes a first pivot flange near the first wing pivot end;

a second wing including a second wing span extending from a second wing frame end to a second wing pivot end, the second wing frame end is configured for coupling with a second window frame, and the second wing includes a second pivot flange near the second wing pivot end;

a pivot clip rotatably coupled between the first and second pivot flanges at first and second pivot joints in an assembled configuration, the pivot clip includes first and second clip sockets; and wherein in the assembled configuration the first pivot joint includes the first pivot flange received within the first clip socket, the second pivot joint includes the second pivot flange received within the second clip socket, and the first and second wings are rotatable relative to the pivot clip at the first and second pivot joints.

2. The mullion cover linkage assembly of claim 1, wherein at least one of the first and second pivot flanges is slidably clamped within one of the first and second clip sockets, and one or more of the first and second clip sockets includes pivot surfaces slidably coupled along opposed faces of one of the respective first and second pivot flanges.

3. The mullion cover linkage assembly of claim 2, wherein the pivot surfaces include:

a first pivot surface, a second pivot surface, and a third pivot surface between the first and second pivot surfaces, wherein the first and second pivot surfaces are slidably coupled along a first face of one of the first and second pivot flanges, and the third pivot surface is slidably coupled along a second face of one of the first and second pivot flanges opposed to the first face.

4. The mullion cover linkage assembly of claim 2, wherein the pivot clip includes:

a clip base, a pivot bar extending from the clip base, the pivot bar includes a pivot surface at one side of at least one of the first and second clip sockets, and one or more clip arms extending from the clip base, at least one clip arm includes an opposed pivot surface at an opposed side of at least one of the first and second clip sockets, and the clip arm directs the opposed pivot surface toward the pivot surface.

5. The mullion cover linkage assembly of claim 4, wherein the pivot bar includes a sealant groove extending along the pivot bar.

6. The mullion cover linkage assembly of claim 1, wherein one or more of the first and second clip sockets extends at least part way around the pivot clip.

7. The mullion cover linkage assembly of claim 1, wherein one or more of the first and second pivot flanges is selectively removable from the pivot clip according to deflection of one or more of the first and second pivot flanges or a clip arm relative to a pivot bar of the pivot clip.

8. The mullion cover linkage assembly of claim 1, comprising a locking block having an anchoring face, the anchoring face is engaged along a clip base.

9. The mullion cover linkage assembly of claim 1, wherein the first and second wings and the pivot clip are configured for coupling between exterior portions of first and second window frames.

10. A window assembly comprising:

a first window including a first window frame, the first window frame includes interior and exterior portions;

a second window including a second window frame, the second window frame includes interior and exterior portions, and the second window frame is at an angle to the first window frame; and a mullion cover linkage assembly coupled between the exterior portions of the first and second window frames, the mullion cover linkage extends across a mullion gap, and in an assembled configuration the mullion cover linkage includes:

a first wing coupled with the exterior portion of the first window frame, a second wing coupled with the exterior portion of the second window frame, and a pivot clip rotatable relative to each of the first wing with the second wing in the assembled configuration.

11. The window assembly of claim 10 comprising a locking block engaged between the first and second window frames.

12. The window assembly of claim 11, wherein the locking block includes an anchoring face, and the anchoring face is engaged along a pivot clip base, and the anchoring face immobilizes the pivot clip relative to the first and second wings and the first and second window frames.

13. The window assembly of claim 12, wherein the anchor face immobilizes the first and second wings relative to the pivot clip and the first and second window frames.

14. The window assembly of claim 10, wherein the first and second wings at least partially conceal the pivot clip, and the first and second wings conceal a locking block engaged between the first and second window frames.

15. The window assembly of claim 10, wherein the first and second wings and the pivot clip seal the mullion gap.

16. The window assembly of claim 15, wherein sealant is applied within a sealant groove extending along a pivot bar of the pivot clip, and the first and second wings include respective first and second pivot flanges engaged along the pivot bar and extending along the sealant groove.

17. The window assembly of claim 10, wherein the first and second wings include respective first and second pivot flanges slidably clamped between opposed pivot surfaces of respective first and second clip sockets in the pivot clip.

18. The window assembly of claim 10, wherein the pivot clip includes:

a clip base, a pivot bar extending from the clip base, the pivot bar includes a pivot surface, one or more clip arms extending from the clip base, at least one clip arm includes an opposed pivot surface, and one or more clip sockets between the pivot bar and the one or more clip arms, each of the clip sockets includes the pivot surface and the opposed pivot surface on opposed sides of the respective clip socket.

19. A window assembly comprising a mullion cover linkage comprising:

a first window including a first window frame;

a second window including a second window frame, and the second window frame is at an angle to the first window frame with a mullion gap between the first and second window frames, the mullion gap tapers from a gap base toward a gap end, and each of the first and second window frames include a header and a sill;

a mullion linkage including:

a first wing configured for coupling with the first window frame; and a second wing configured for coupling with the second window frame, the second wing is movably coupled with the first wing at a rotatable joint;

wherein the first and second wings are continuously engaged at the rotatable joint from the respective headers to the sills of the first and second window frames, and the continuous engagement seals an interior of the window assembly on one side of the mullion cover linkage from an exterior of the window assembly on an opposed side of the mullion cover linkage; and wherein the mullion cover linkage is deflected at the rotatable joint between two or more configurations including:

a first configuration with the second wing at a first angle relative to the first wing, and a second configuration with the second wing at a second angle relative to the first wing, and the second angle is different from the first angle, and in the second configuration a width of the mullion cover linkage is configured to match and span a gap base between the first and second window frames.

20. The window assembly of claim 19, wherein one of the first and second wings includes a pivot clip, and the other of the first and second wings includes a pivot flange, and the rotatable joint includes the pivot flange movably coupled with the pivot clip.

21. The window assembly of claim 20, wherein the pivot flange is slidably clamped with the pivot clamp.

22. The window assembly of claim 20, wherein the pivot flange is slidably engaged between opposed pivot surfaces of the pivot clip.

23. The window assembly of claim 19 comprising a pivot clip interposed between the first and second wings at the rotatable joint, the pivot clip includes one or more clip sockets, each of the clip sockets are configured to receive portions of the first and second wings, respectively, and the first and second wings are coupled with one another through the pivot clip.

24. The window assembly of claim 19, wherein the mullion cover linkage is coupled between exterior portions of the first and second window frames in the second configuration.

25. The window assembly of claim 19 comprising a locking block engaged between the first and second window frames, and the locking block includes an anchoring face, and the anchoring face is engaged with at least one of the first and second wings, and the anchoring face immobilizes the mullion cover linkage relative to the first and second window frames.

* * * * *

UNITED STATES PATENT AND TRADEMARK OFFICE

CERTIFICATE OF CORRECTION

PATENT NO. : 8,904,720 B2
APPLICATION NO. : 13/427185
DATED : December 9, 2014
INVENTOR(S) : Woodward et al.

It is certified that error appears in the above-identified patent and that said Letters Patent is hereby corrected as shown below:

On the Title page, in item (73), in "Assignee", in column 1, line 1-2, delete "Marvin Lumber and Cedar Company, Warroad, MN (US)" and insert --Marvin Lumber and Cedar Company, d/b/a Marvin Windows and Doors, Warroad, MN (US)--, therefor Signed and Sealed this
Thirtieth Day of June, 2015

Michelle K. Lee

Michelle K. Lee
*Director of the United States Patent and Trademark Office*